US011180879B2

(12) United States Patent
Yamanashi et al.

(10) Patent No.: US 11,180,879 B2
(45) Date of Patent: Nov. 23, 2021

(54) SEWING MACHINE AND PATTERN ALIGNMENT METHOD

(71) Applicant: BROTHER KOGYO KABUSHIKI KAISHA, Nagoya (JP)

(72) Inventors: Yoko Yamanashi, Konan (JP); Yukiyoshi Muto, Nagoya (JP); Fuyuki Nakashima, Ibi-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 86 days.

(21) Appl. No.: 16/816,465

(22) Filed: Mar. 12, 2020

(65) Prior Publication Data

US 2020/0308745 A1 Oct. 1, 2020

(30) Foreign Application Priority Data

Mar. 28, 2019 (JP) ..... JP2019-064931

(51) Int. Cl.

| | |
|---|---|
| ***D05B 19/16*** | (2006.01) |
| ***D05C 9/22*** | (2006.01) |
| ***D05C 9/06*** | (2006.01) |
| ***D05B 19/00*** | (2006.01) |
| ***D05B 19/14*** | (2006.01) |
| ***D05B 69/12*** | (2006.01) |
| ***D05C 3/02*** | (2006.01) |
| ***D05B 39/00*** | (2006.01) |

(52) U.S. Cl.

CPC ..... *D05B 19/16* (2013.01); *D05B 19/006* (2013.01); *D05B 19/14* (2013.01); *D05B 39/00* (2013.01); *D05B 69/12* (2013.01); *D05C 3/02* (2013.01); *D05C 9/06* (2013.01); *D05C 9/22* (2013.01)

(58) Field of Classification Search

CPC ..... D05B 19/10; D05B 19/14; D05B 19/16; D05C 5/02; D05C 9/06; D05C 9/22

USPC ..... 700/136–138

See application file for complete search history.

(56) References Cited

U.S. PATENT DOCUMENTS 5,553,559 A * 9/1996 Inoue ..... D05B 19/08 112/102.5

5,855,176 A * 1/1999 Takenoya ..... D05B 19/08 112/102.5

(Continued)

FOREIGN PATENT DOCUMENTS

JP 2016-106860 A 6/2016

*Primary Examiner* — Nathan E Durham

(74) *Attorney, Agent, or Firm* — Oliff PLC

(57) ABSTRACT

A sewing machine includes a sewing portion, a movement portion, a processor and a memory. The memory is configured to store computer-readable instructions that, when executed by the processor, instruct the processor to perform processes. The processes include acquiring pattern data indicating positions of a plurality of needle drop points to sew a pattern, acquiring a position of a sewing start point of the pattern, performing first correction, performing second correction that uses the acquired position of the sewing start point as a base point, and corrects the pattern data, by changing, by an acquired change amount, the positions of the plurality of needle drop points represented by the pattern data corrected by the first correction, and controlling the sewing portion and the movement portion and sewing the pattern on the sewing object, in accordance with the pattern data corrected by the second correction.

11 Claims, 23 Drawing Sheets

(56) References Cited

U.S. PATENT DOCUMENTS

| | | | | |
|---|---|---|---|---|
| 5,865,133 | A * | 2/1999 | Herbach | D05B 21/00 112/475.19 |
| 6,000,350 | A * | 12/1999 | Koike | D05B 19/10 112/102.5 |
| 6,167,822 | B1 * | 1/2001 | Miyasako | D05B 19/006 112/102.5 |
| 8,061,286 | B2 * | 11/2011 | Hirata | D05C 5/04 112/470.01 |
| 8,539,893 | B2 * | 9/2013 | Tokura | D05C 9/02 112/103 |
| 8,763,541 | B2 * | 7/2014 | Tokura | D05C 5/06 112/102.5 |
| 2010/0242817 | A1 * | 9/2010 | Tokura | D05B 19/12 112/102.5 |
| 2013/0081562 | A1 * | 4/2013 | Tokura | D05C 13/02 112/78 |
| 2016/0160414 | A1 | 6/2016 | Oda et al. | |
| 2018/0258569 | A1 * | 9/2018 | Kamihira | D05B 19/12 |

* cited by examiner

SEWING MACHINE AND PATTERN ALIGNMENT METHOD

CROSS-REFERENCE TO RELATED APPLICATION

This application claims priority to Japanese Patent Application No. 2019-064931 filed Mar. 28, 2019, the content of which is hereby incorporated herein by reference in its entirety.

BACKGROUND

The present disclosure relates to a sewing machine and a pattern alignment method.

When a border pattern is sewn in which a plurality of the same patterns are arranged in a row, a known sewing machine arranges a marker used for alignment between the plurality of patterns at a given position with respect to the patterns, and displays the marker together with the patterns. Using the marker, a user adjusts the arrangement between the plurality of patterns. The sewing machine generates pattern data to sew, on a sewing object, the plurality of patterns for which the arrangement is adjusted by the user.

SUMMARY

The pattern actually sewn in accordance with the pattern data may be sewn at a position that is slightly displaced from a sewing position indicated by the pattern data, due to material puckering of the sewing object or the like. When using the known sewing machine, the user needs to perform an operation to adjust the arrangement between the plurality of patterns while taking account of the actual sewing position of the precedingly sewn pattern, which is troublesome.

Embodiments of the broad principles derived herein provide a sewing machine and a pattern alignment method that are capable of performing pattern alignment using a simpler operation than in related art.

Embodiments provide a sewing machine that includes a sewing portion, a movement portion, a processor and a memory. The sewing portion has a needle bar. The sewing portion is configured to form stitches on a sewing object by moving the needle bar up and down. The movement portion has a holder on which an embroidery frame that holds the sewing object is detachably mounted. The movement portion is configured to move the holder with respect to the needle bar. The processor is configured to control the sewing portion and the movement portion. The memory is configured to store computer-readable instructions that, when executed by the processor, instruct the processor to perform processes. The processes include acquiring pattern data indicating positions of a plurality of needle drop points to sew a pattern, using a coordinate system of the movement portion, acquiring a position of a sewing start point of the pattern indicated by the coordinate system of the movement portion, performing first correction that corrects the pattern data by moving the positions of the plurality of needle drop points represented by the acquired pattern data in accordance with a difference between a position of the sewing start point represented by the pattern data and the acquired position of the sewing start point, and acquiring a change amount by which the positions of the plurality of needle drop points represented by the pattern data corrected by the first correction are changed, using the acquired position of the sewing start point as a base point. The processes include performing second correction that uses the acquired position of the sewing start point as the base point, and corrects the pattern data corrected by the first correction, by changing, by the acquired change amount, the positions of the plurality of needle drop points represented by the pattern data corrected by the first correction, and controlling the sewing portion and the movement portion and sewing the pattern on the sewing object held by the embroidery frame, in accordance with the pattern data corrected by the second correction.

Embodiments further provide a pattern alignment method that includes a pattern data acquiring step of acquiring pattern data to sew a pattern using a sewing machine. The sewing machine includes a sewing portion, a movement portion and a processor. The sewing portion has a needle bar and is configured to form stitches on a sewing object by moving the needle bar up and down. The movement portion has a holder and is configured to move the holder with respect to the needle bar. The holder is configured to detachably mount thereon an embroidery frame that holds the sewing object. The processor is configured to control the sewing portion and the movement portion. The pattern data indicates positions of a plurality of needle drop points to sew the pattern using the sewing machine, using a coordinate system of the movement portion. The pattern alignment method includes a position acquiring step of acquiring a position of a sewing start point of the pattern indicated by the coordinate system of the movement portion, a first correcting step of correcting the pattern data by moving the positions of the plurality of needle drop points represented by the pattern data acquired by the pattern data acquiring step, in accordance with a difference between a position of the sewing start point represented by the pattern data and the position of the sewing start point acquired by the position acquiring step, and a corner portion notifying step of performing notification of a position of at least one of two corner portions that are in contact with a side separated from the sewing start point, among four corner portions of a mask that is a rectangular graphic indicating a position and a size of the pattern represented by the pattern data corrected by the first correcting step. The pattern alignment method further includes a change amount acquiring step of acquiring a change amount when the position of the at least one of the two corners notified by the corner portion notifying step is changed in accordance with a position of a reference graphic on the sewing object held by the embroidery frame, a second correcting step of correcting the pattern data corrected by the first correcting step, by changing the positions of the plurality of needle drop points represented by the pattern data corrected by the first correcting step, in accordance with the change amount acquired by the change amount acquiring step, using the position of the sewing start point acquired by the position acquiring step as a base point, and a sewing control step of controlling the sewing portion and the movement portion and sewing the pattern on the sewing object held by the embroidery frame, in accordance with the pattern data corrected by the second correcting step.

BRIEF DESCRIPTION OF THE DRAWINGS

Embodiments will be described below in detail with reference to the accompanying drawings in which.

DETAILED DESCRIPTION

Figure 1:
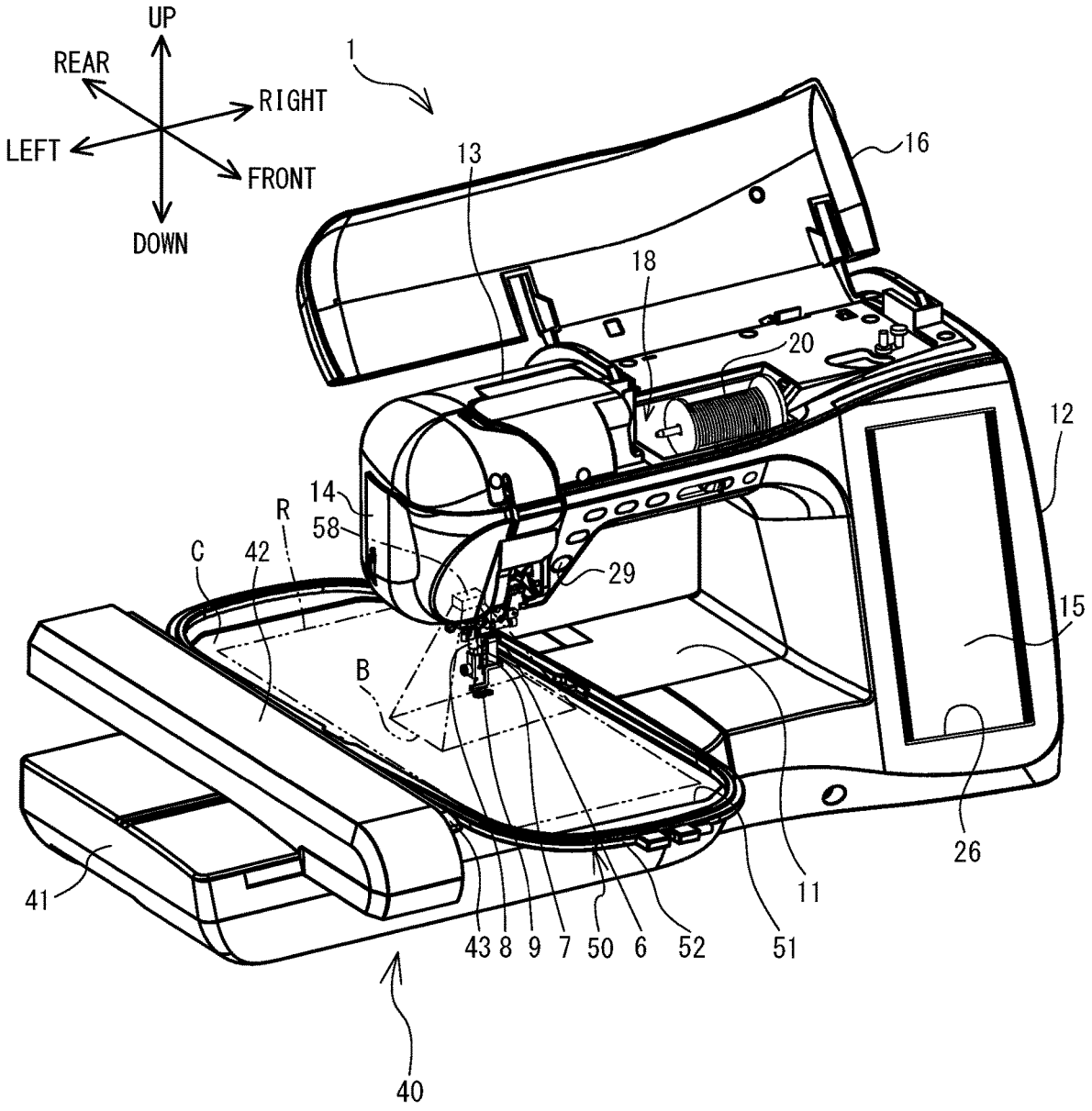
FIG. 1 is a perspective view of a sewing machine on which a movement portion is mounted.

First and second embodiments of the present disclosure will be explained sequentially with reference to the drawings. A physical configuration of a sewing machine 1 on which a movement portion 40 is mounted will be explained with reference to FIG. 1 and FIG. 2, the physical configuration of a sewing machine 1 is common to first and second embodiments. The up-down direction, the lower right side, the upper left side, the lower left side and the upper right side of FIG. 1 respectively correspond to the up-down direction, the front side, the rear side, the left side and the right side of the sewing machine 1 on which the movement portion 40 is mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

Figure 2:
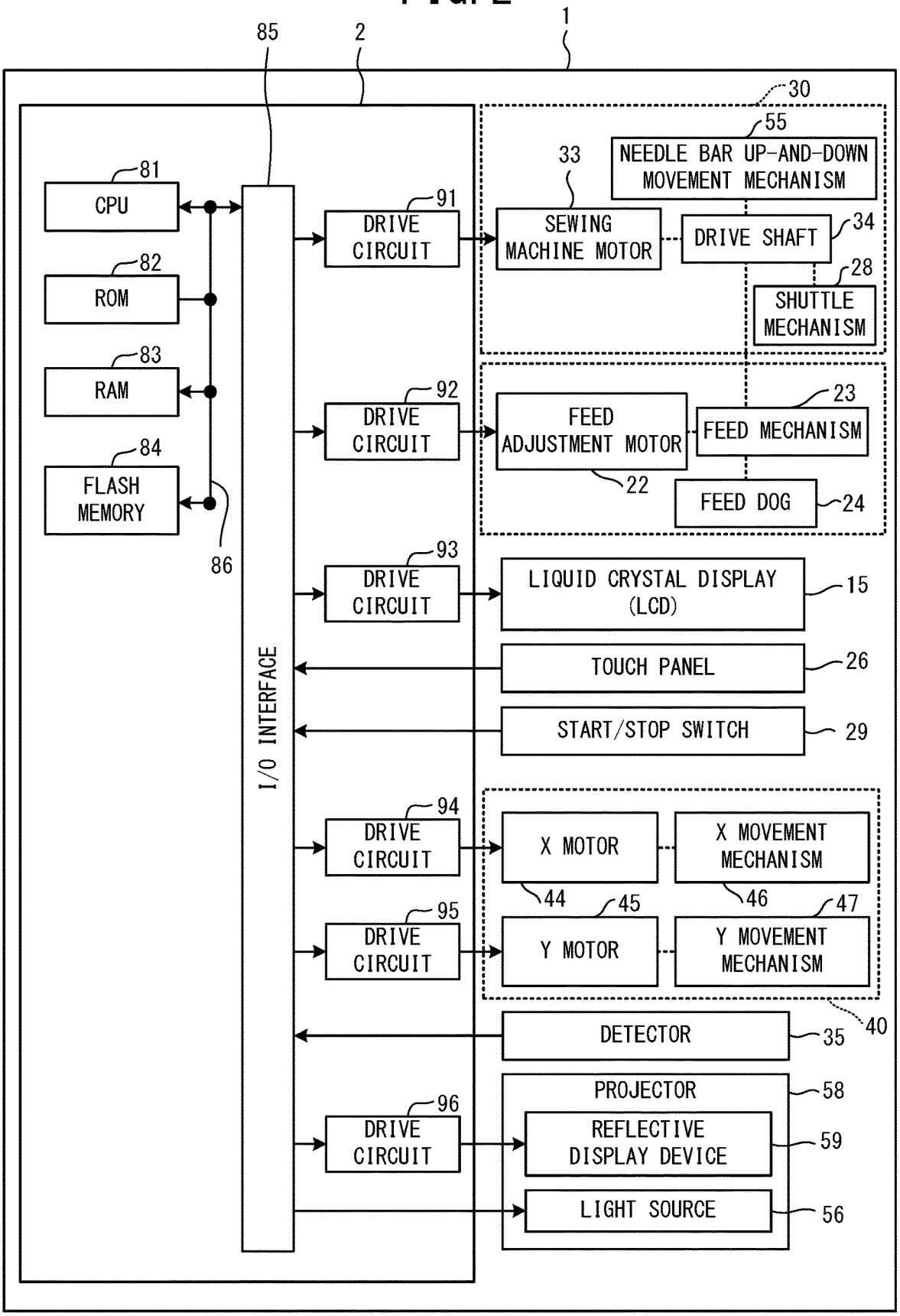
FIG. 2 is a block diagram showing an electrical configuration of the sewing machine.

The upper surface of the bed portion 11 is provided with a needle plate (not shown in the drawings). The needle plate includes a needle hole (not shown in the drawings) through which a sewing needle 7 to be described later is insertable. A feed dog 24, a feed mechanism 23, a shuttle mechanism 28 (that are shown in FIG. 2), a thread cutting mechanism (not shown in the drawings) and the like are provided inside the bed portion 11 of the sewing machine 1. The feed dog 24 is driven by the feed mechanism 23 during normal sewing other than embroidery sewing, and moves a sewing object by a predetermined movement amount. The shuttle mechanism 28 entwines an upper thread (not shown in the drawings) with a lower thread (not shown in the drawings) below the needle plate. The thread cutting mechanism is configured to catch and cut the upper thread and the lower thread.

An LCD 15 is provided in the front surface of the pillar 12. The LCD 15 displays an image including various items, such as commands, illustrations, setting values, messages and the like. A touch panel 26, which can detect a depressed position, is provided on the front surface side of the LCD 15. When a user performs a pressing operation on the touch panel 26, using a finger or a stylus pen (not shown in the drawings), the touch panel 26 detects the depressed position. A processor 2 (refer to FIG. 2) of the sewing machine 1 recognizes a selected item on the image, on the basis of the detected depressed position. Hereinafter, the pressing operation on the touch panel 26 by the user is referred to as a panel operation. Through the panel operation, the user can select an embroidery pattern that the user wants to sew, a command to be executed, and the like. A sewing machine motor 33 (refer to FIG. 2) is provided inside the pillar 12.

An upper portion of the arm portion 13 is provided with a cover 16 that can open and close. FIG. 1 shows a state in which the cover 16 is open. A thread housing portion 18 is provided below the cover 16 (namely, inside the arm portion 13) when the cover 16 is in a closed state. The thread housing portion 18 can house a thread spool 20 around which the upper thread is wound. A drive shaft 34 (refer to FIG. 2) that extends in the left-right direction is provided inside the arm portion 13. The drive shaft 34 is driven to rotate by the sewing machine motor 33. Various switches, including a start/stop switch 29, are provided on a lower left portion of the front surface of the arm portion 13. The start/stop switch 29 starts or stops the operation of the sewing machine 1, namely, is used to input a sewing start command or a sewing stop command.

The head portion 14 is provided with a sewing portion 30 (refer to FIG. 2), a presser bar 8, a projector 58 and the like. The sewing portion 30 includes a needle bar 6, and is configured to form stitches on a sewing object C by moving the needle bar 6 up and down. The needle bar 6 is positioned above the needle hole. The sewing needle 7 is detachably mounted on the lower end of the needle bar 6. The sewing portion 30 further includes the drive shaft 34, and a needle bar up-and-down movement mechanism 55 that drives the needle bar 6 in the up-down direction as a result of the rotation of the drive shaft 34. A presser foot 9 is detachably mounted on the lower end portion of the presser bar 8. The presser foot 9 can move between a lowered position in which the presser foot 9 presses the sewing object C together with the presser bar 8, and a raised position in which the presser foot 9 is retracted (separated from the sewing object C) upward from the lowered position. The presser foot 9 intermittently presses the sewing object C downward, in synchronization with the up-and-down movement of the needle bar 6.

The projector 58 is configured to project a color image toward the bed portion 11. The projector 58 is provided with a cylindrical housing, a reflective display device 59 housed in the housing, a light source 56 (refer to FIG. 2) and an imaging lens (not shown in the drawings). The housing is fixed to a machine frame inside the head portion 14. The light source 56 is an LED. The reflective display device 59 modulates light from the light source 56, and forms an image light of a projected image on the basis of image data that represents the projected image. The imaging lens focuses the image light formed by the reflective display device 59 on the sewing object C held by an embroidery frame 50 mounted on a holder 43. An area onto which the projected image is projected is referred to as a projection area B. The projection area B includes a position below the needle bar 6, namely, a position corresponding to the needle hole. The projection area B is an area that is uniquely defined in accordance with an attachment position and an attachment posture of the projector 58, a distance from the imaging lens to the upper surface of the sewing object C, and the like. The projector 58 of the present embodiment projects the projected image onto the sewing object C (the bed portion 11) from diagonally above. Therefore, processing to correct image distortion is performed on the projected image. The size of the projection area B (the number of dots of a long side and a short side of a rectangular area, for example) of the projector 58 of the present embodiment is stored in advance in a flash memory 84 to be described later.

The movement portion 40 is detachably mounted on the bed portion 11 of the sewing machine 1. The movement portion 40 is provided with a holder 43 a holder that is configured to mount with embroidery frame 50 configured to hold a sewing object C, and the movement portion 40 is configured to relatively move the holder 43 with respect to the needle bar 6. The single embroidery frame selected from among a plurality of types of embroidery frames including the embroidery frame 50, can be mounted on and removed from the movement portion 40. The embroidery frame 50 includes a first frame 51 and a second frame 52, and is configured to hold the sheet-shaped sewing object C (a work cloth, for example) with the first frame 51 and the second frame 52. The movement portion 40 is provided with a main body portion 41 and a carriage 42. The carriage 42 is provided with the holder 43, a Y movement mechanism 47 and a Y motor 45 shown in FIG. 2. The holder 43 is provided on the right side surface of the carriage 42. The embroidery frame 50 is configured to be mounted on and removed from the holder 43. The Y movement mechanism 47 causes the holder 43 to move in the front-rear direction (a Y direction). The Y motor 45 is configured to drive the Y movement mechanism 47. The main body portion 41 is internally provided with an X movement mechanism 46 and an X motor 44 shown in FIG. 2. The X movement mechanism 46 causes the carriage 42 to move in the left-right direction (an X direction). The X motor 44 is configured to drive the X movement mechanism 46. When embroidery sewing is performed using the embroidery frame 50, the movement portion 40 is configured to move the embroidery frame 50 mounted on the holder 43 of the carriage 42 to a position indicated by an XY coordinate system (an embroidery coordinate system) specific to the embroidery frame 50. In the present embodiment, the right direction is defined as the X plus direction, and the rear direction is defined as the Y plus direction.

An electrical configuration of the sewing machine 1 that is common to first and second embodiments will be explained with reference to FIG. 2. The sewing machine 1 is provided with a CPU 81, a ROM 82, a RAM 83, the flash memory 84 and an input/output (I/O) interface 85. The CPU 81 is connected to the ROM 82, the RAM 83, the flash memory 84 and the I/O interface 85, via a bus 86.

The CPU 81 performs overall control of the sewing machine 1 and performs various types of calculations and processing that relate to sewing, in accordance with various programs stored in the ROM 82. The ROM 82 is provided with a plurality of storage areas (not shown in the drawings) including a program storage area. The various programs (including a program to execute main processing described later) to operate the sewing machine 1 are stored in the program storage area.

The RAM 83 is provided with a storage area to store calculation results etc. obtained by the CPU 81 performing arithmetic processing. The flash memory 84 stores various parameters etc. for the sewing machine 1 to perform various types of processing. The flash memory 84 stores pattern data to sew various patterns that can be sewn by the sewing machine 1, for each of the plurality of patterns. The pattern data includes coordinate data. The coordinate data is data that indicates formation positions of the stitches (positions of the needle drop points) included in the pattern, using coordinates of the embroidery coordinate system. More specifically, the coordinate data includes a data group representing a plurality of coordinates of each of the needle drop points. The flash memory 84 further stores a correspondence between a type of the embroidery frame that can be mounted on the holder 43 and a sewing area. The sewing area is an area in which sewing is possible, and is set inside the embroidery frame mounted on the holder 43 of the sewing machine 1. The flash memory 84 of the present embodiment further stores a variable that associates the coordinates of the embroidery coordinate system with coordinates of a projection coordinate system that is a coordinate system of the projected image of the projector 58. Therefore, the sewing machine 1 can perform processing to identify the coordinates of the projection coordinate system, on the basis of the pattern data. For example, the sewing machine 1 can project the pattern represented by the pattern data onto a position at which the pattern is sewn on the sewing object C held by the embroidery frame 50. Drive circuits 91 to 96, the touch panel 26, the start/stop switch 29, the light source 56 of the projector 58 and a detector 35 are connected to the I/O interface 85. The light source 56 emits light in accordance with a control signal from the CPU 81, and projects the projected image displayed on the reflective display device 59 onto the sewing object that is to be moved on the bed portion 11. The detector 35 is configured to detect that the embroidery frame 50 has been mounted on the movement portion 40, and to output a detection result corresponding to the type of the embroidery frame. The detector 35 of the present embodiment is configured to detect the type of embroidery frame according to the ON and OFF combination of a plurality of mechanical switches.

The drive circuit 91 is connected to the sewing machine motor 33. The drive circuit 91 drives the sewing machine motor 33 in accordance with a control signal from the CPU 81. When the sewing machine motor 33 is driven, the needle bar up-and-down movement mechanism 55 is driven via the drive shaft 34 of the sewing machine 1, and the needle bar 6 moves up and down. The drive circuit 92 is connected to a feed adjustment motor 22. The drive circuit 93 drives the LCD 15 in accordance with a control signal from the CPU 81, and causes an image to be displayed on the LCD 15. The drive circuit 94 is connected to the X motor 44. The drive circuit 95 is connected to the Y motor 45. The drive circuits 94 and 95 drive the X motor 44 and the Y motor 45, respectively, in accordance with a control signal from the CPU 81. When the X motor 44 and the Y motor 45 are driven, the embroidery frame 50 mounted on the movement portion 40 moves in the left-right direction (the X direction) and the front-rear direction (the Y direction) by a movement amount corresponding to the control signal. The drive circuit 96 drives the reflective display device 59 in accordance with a control signal from the CPU 81, and causes the reflective display device 59 to project the projected image.

Operations of the sewing machine 1 will be explained briefly. When embroidery sewing is performed using the embroidery frame 50, the needle bar up-and-down movement mechanism 55 and the shuttle mechanism 28 are driven in combination with the embroidery frame 50 being moved in the X direction and the Y direction by the movement portion 40. Thus, an embroidery pattern is sewn on the sewing object C held by the embroidery frame 50, using the sewing needle 7 mounted on the needle bar 6.

Main processing and a pattern alignment method of the sewing machine 1 of the first embodiment will be explained with reference to FIG. 3 to FIG. 20. In the main processing, the processor 2 generates embroidery data to sew a rectangular frame-shaped embroidery pattern in which a first pattern and a second pattern to be described later are combined. On the basis of the generated embroidery data, the processor 2 performs processing to sew the embroidery pattern on the sewing object C held by the embroidery frame 50. For example, the embroidery pattern is sewn on a rectangular frame-shaped edge portion that is arranged on the outer circumference of a rectangular patchwork quilt. A rectangle inside the rectangular frame-shaped edge portion is specified by the user before performing the main processing, and is visibly shown on the sewing object C using a tailor's chalk pen or the like, for example. The main processing is activated when the user inputs a command to start editing the embroidery pattern. When the processor 2 detects the command, the processor 2 reads out, to the RAM 83, a program to execute the main processing stored in the program storage area of the ROM 82. In accordance with instructions included in the program read out to the RAM 83, the processor 2 performs the following steps. Various parameters necessary to perform the main processing are stored in the flash memory 84. Various data obtained in the course of the main processing are stored in the RAM 83 as appropriate. Hereinafter, step will be abbreviated to S. In FIG. 4A to FIG. 4C, FIG. 5, FIG. 7, FIG. 8A, FIG. 8B, and FIG. 10 to FIG. 20, the arrangement of the patterns is shown by defining the left-right direction and the up-down direction in the drawings, respectively, as the X direction and the Y direction of the embroidery coordinate system.

Figure 3:
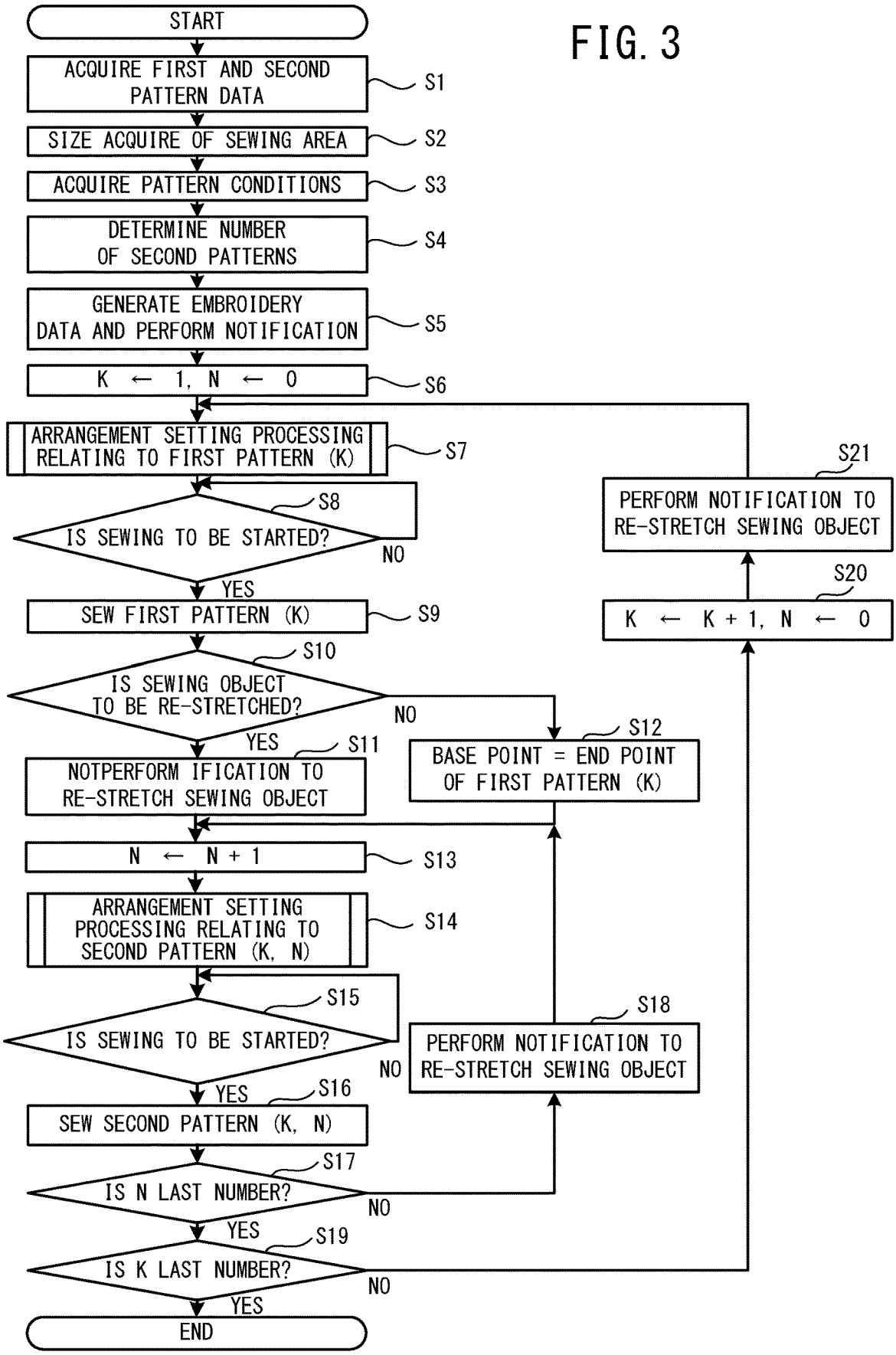
FIG. 3 is a flowchart of main processing of a first embodiment.

As shown in FIG. 3, the processor 2 acquires first pattern data to sew the first pattern, and second pattern data to sew the second pattern (S1). The first pattern is a pattern that is arranged in each of four corner portions of the rectangular frame-shaped embroidery pattern. The second pattern is a pattern that is arranged in each of four side portions that join the four corner portions. Through the panel operation, the user inputs a command to select desired patterns, respectively, as the first pattern and the second pattern from among a plurality of types of patterns stored in the flash memory 84, for example. On the basis of the input command, the processor 2 acquires, for example, the first pattern data to sew a first pattern E1 shown in FIG. 4A, and the second pattern data to sew a second pattern E2.

Figure 4A:
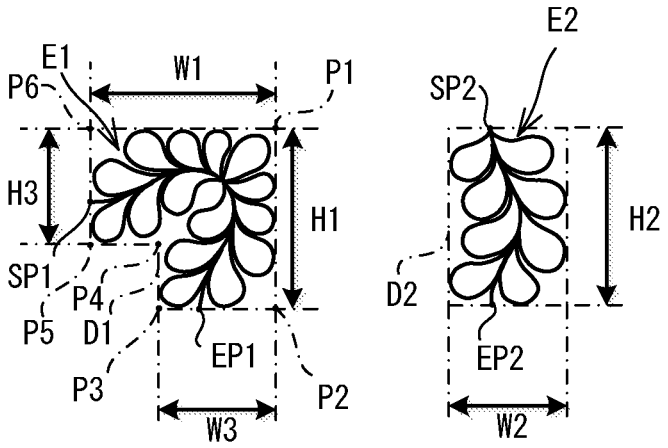
FIG. 4A is an explanatory diagram of a first pattern and a second pattern.
Figure 4B:
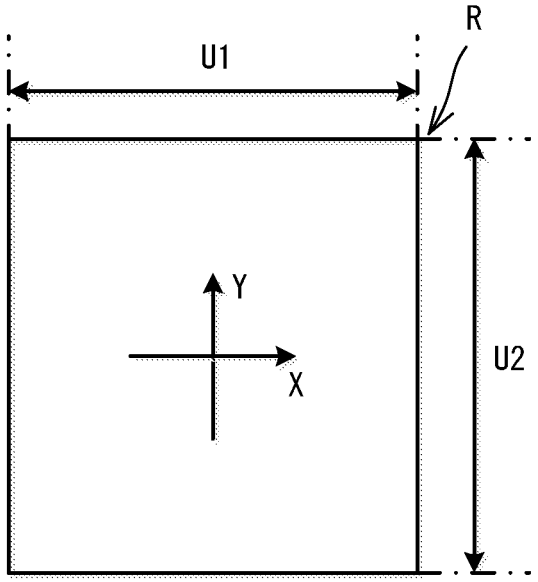
FIG. 4B is an explanatory diagram of a sewing area.

As shown in FIG. 4A, each of the first pattern E1 and the second pattern E2 of the present embodiment is a pattern that is represented by one continuous line. The first pattern E1 is encompassed by an L-shaped graphic D1 having six sides obtained by sequentially connecting a point P1 to a point P6. The graphic D1 is used as a reference when the size and the angle of the first pattern E1 are changed. Of the vertices of the graphic D1, the point P4 corresponds to a point 65 at a corner of an inner peripheral contour 64 of an area 60 to be described later, and the point P1 corresponds to a point 66 at a corner of an outer peripheral contour 63 of the area 60 to be described later. Graphic data representing the graphic D1 is stored in the flash memory 84 in association with the first pattern data. The size of the first pattern E1 is represented by lengths W1 and H1 of two sides that connect to the point P1, namely, two sides in descending order of the length of the six sides of the graphic D1. The lengths W1 and H1 of the two sides in descending order of the length of the six sides of the graphic D1 may be the same as each other or may be different from each other. A start point SP1 and an end point EP1 of the first pattern E1 respectively correspond to a start point and an end point of the first pattern E1 at the time of sewing.

The second pattern E2 is encompassed by a rectangle D2. The rectangle D2 is the smallest rectangle that encompasses the second pattern E2. The rectangle D2 is used as a reference when the size and the angle of the second pattern E2 are changed. Graphic data representing the rectangle D2 is stored in the flash memory 84 in association with the second pattern data. A start point SP2 and an end point EP2 of the line representing the second pattern E2 are arranged on two sides, of the four sides of the rectangle D2, that face each other. The direction in which a line segment connecting the start point SP2 and the end point EP2 extends is also referred to as a length direction of the second pattern E2, and the direction perpendicular to the length direction of the second pattern E2 is also referred to as a width direction of the second pattern E2. The size of the second pattern E2 is represented by a length H2 in the length direction of the rectangle D2 and a length W2 in the width direction of the rectangle D2. The length H2 and the length W2 may be the same as each other or may be different from each other. The start point SP2 and the end point EP2 of the second pattern E2 respectively correspond to a start point and an end point of the second pattern E2 at the time of sewing.

The processor 2 acquires the size of a sewing area R that is set inside the embroidery frame 50 mounted on the holder 43 (S2). For example, the processor 2 acquires the size of the sewing area R on the basis of the type of the embroidery frame 50 identified on the basis of an output value of the detector 35 and the correspondence between the type of the embroidery frame 50 and the size of the sewing area R stored in the flash memory 84. The method for acquiring the size of the sewing area R may be changed as appropriate and, for example, a value input by the user may be acquired. For example, the processor 2 detects the type of the embroidery frame 50 that is different from the type of the embroidery frame 50 shown in FIG. 1, and acquires the size of the sewing area R shown in FIG. 4B. The sewing area R shown in FIG. 4B has a rectangular shape having sides extending in the X direction and the Y direction of the embroidery coordinate system, and the size of the sewing area R is represented by a length U1 in the X direction of the embroidery coordinate system and a length U2 in the Y direction. For example, the length U1 in the X direction is 5 to 30 cm, and the length U2 in the Y direction is 5 to 30 cm. The sewing area R is larger than the projection area B.

Figure 4C:
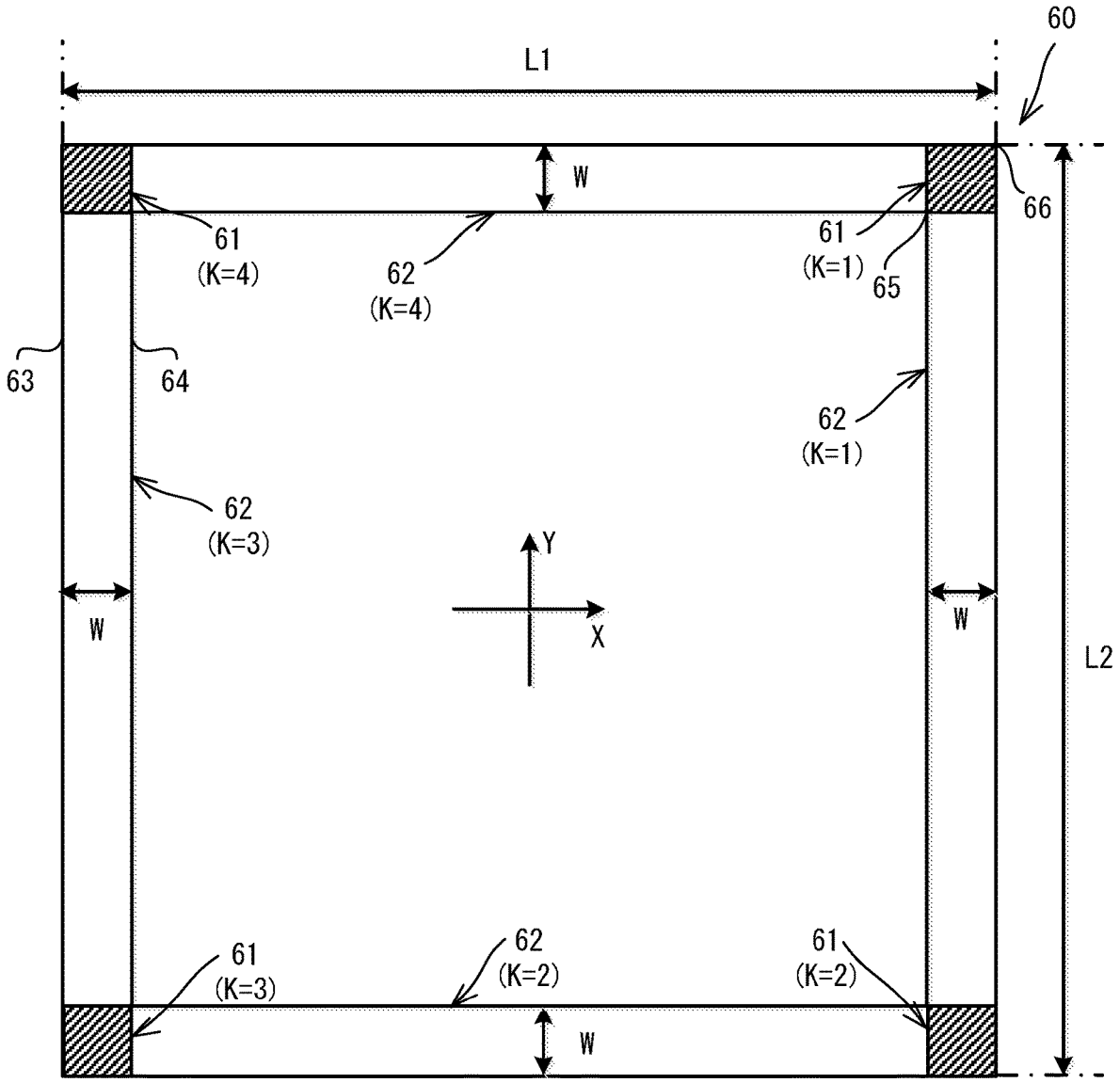
FIG. 4C is an explanatory diagram of an area in which an embroidery pattern is arranged.

The processor 2 acquires pattern conditions for the rectangular frame-shaped embroidery pattern (S3). The first pattern E1 and the second pattern E2 included in the embroidery pattern of the present embodiment are arranged so as to be contained within the rectangular frame-shaped area 60 that is shown in FIG. 4C and that extends in the X direction and the Y direction of the embroidery coordinate system. The area 60 is the rectangular frame-shaped area between the outer peripheral contour 63 and the inner peripheral contour 64. The area 60 has four corner portions 61 shown by diagonal hatching, and four side portions 62 each having a rectangular shape and forming a connection between the corner portion 61 and the corner portion 61. The corner portion 61 has a rectangular shape having a diagonal line connecting the point 65 and the point 66. The size of the embroidery pattern is represented by a length L1 in the X direction and a length L2 in the Y direction of the outer peripheral contour 63 of the area 60, and a width W. The width W is a distance between the outer peripheral contour 63 and the inner peripheral contour 64 in a direction perpendicular to the inner peripheral contour 64. In the present embodiment, the width W is the same value regardless of the four sides that form the inner peripheral contour 64. The width W may be a different value between the four sides that form the inner peripheral contour 64. On the basis of a numeric value input by the user through the panel operation, the processor 2 acquires the lengths L1 and L2 and the width W, as the pattern conditions. The lengths L1 and L2 are within a range from 80 to 300 cm, for example. The width W is within a range from 3 to 20 cm, for example. In a specific example, the same value is acquired as the lengths L1 and L2.

On the basis of the pattern conditions acquired at S3, the processor 2 determines a number N of the second patterns E2 that are arranged in the four side portions 62 of the embroidery pattern (S4). In the specific example, the length W in the width direction of the four side portions 62 is the same as each other. Thus, the processor 2 sets the number and size of the second patterns E2 to be arranged in each of a pair of the side portions 62 that extend in the X direction to be the same number and size. The processor 2 sets the number and size of the second patterns E2 to be arranged in each of a pair of the side portions 62 that extend in the Y direction to be the same number and size. For example, the processor 2 determines the number N of the second patterns E2 according to the following procedure.

On the basis of Expression (1), the processor 2 provisionally determines a length F in the length direction of the second pattern E2 (the rectangle D2) when the second pattern E2 is enlarged or contracted at a ratio established when the length W2 in the width direction of the rectangle D2 associated with the second pattern E2 acquired at S1 is set to the length W acquired at S3. More specifically, the processor 2 calculates the length F in the length direction of a similar figure of the second pattern E2 obtained under the condition that the length in the width direction of the rectangle D2 associated with the second pattern E2 is the length W acquired at S3.

$$F=H2\times W/W2 \quad \text{Expression (1)}$$

On the basis of Expression (2) and Expression (3), the processor 2 calculates lengths G and J corresponding to the lengths W1 and H1 of the first pattern E1 (the graphic D1) when the first pattern E1 is enlarged or contracted at a ratio established when lengths W3 and H3 of the graphic D1 associated with the first pattern E1 acquired at S1 are set to the length W acquired at S3. The length H3 is a length of a side connecting the point P5 and the point P6 of the graphic D1, and the length W3 is a length of a side connecting the point P2 and P3 of the graphic D1. The length of the side connecting the point P5 and the point P6, and the length of the side connecting the point P2 and the point P3 correspond to the width W of the area 60.

$$G=W1\times W/W3 \quad \text{Expression (2)}$$

$$J=H1\times W/H3 \quad \text{Expression (3)}$$

The processor 2 calculates a number NX of the second patterns E2 to be arranged in the side portion 62 that extends in the X direction, in accordance with Expression (4), for example. The processor 2 calculates a number NY of the second patterns E2 to be arranged in the side portion 62 that extends in the Y direction, in accordance with Expression (5), for example. The Round function is a function relating to a digit number that is specified by rounding off an argument in parentheses. In the specific example, since the lengths L1 and L2 are the same as each other, both the numbers NX and NY are calculated to be 7, for example. The processor 2 calculates a length FX in the length direction of each of the second patterns E2 tobe arranged in the side portion 62 extending in the X direction, in accordance with Expression (6), for example. The processor 2 calculates a length FY in the length direction of each of the second patterns E2 to be arranged in the side portion 62 extending in the Y direction, in accordance with Expression (7), for example.

$$NX=\text{Round}((L1-G-J)/F) \quad \text{Expression (4)}$$

$$NY=\text{Round}((L2-G-J)/F) \quad \text{Expression (5)}$$

$$FX=(L1-G-J)/NX \quad \text{Expression (6)}$$

$$FY=(L2-G-J)/NY \quad \text{Expression (7)}$$

Figure 5:
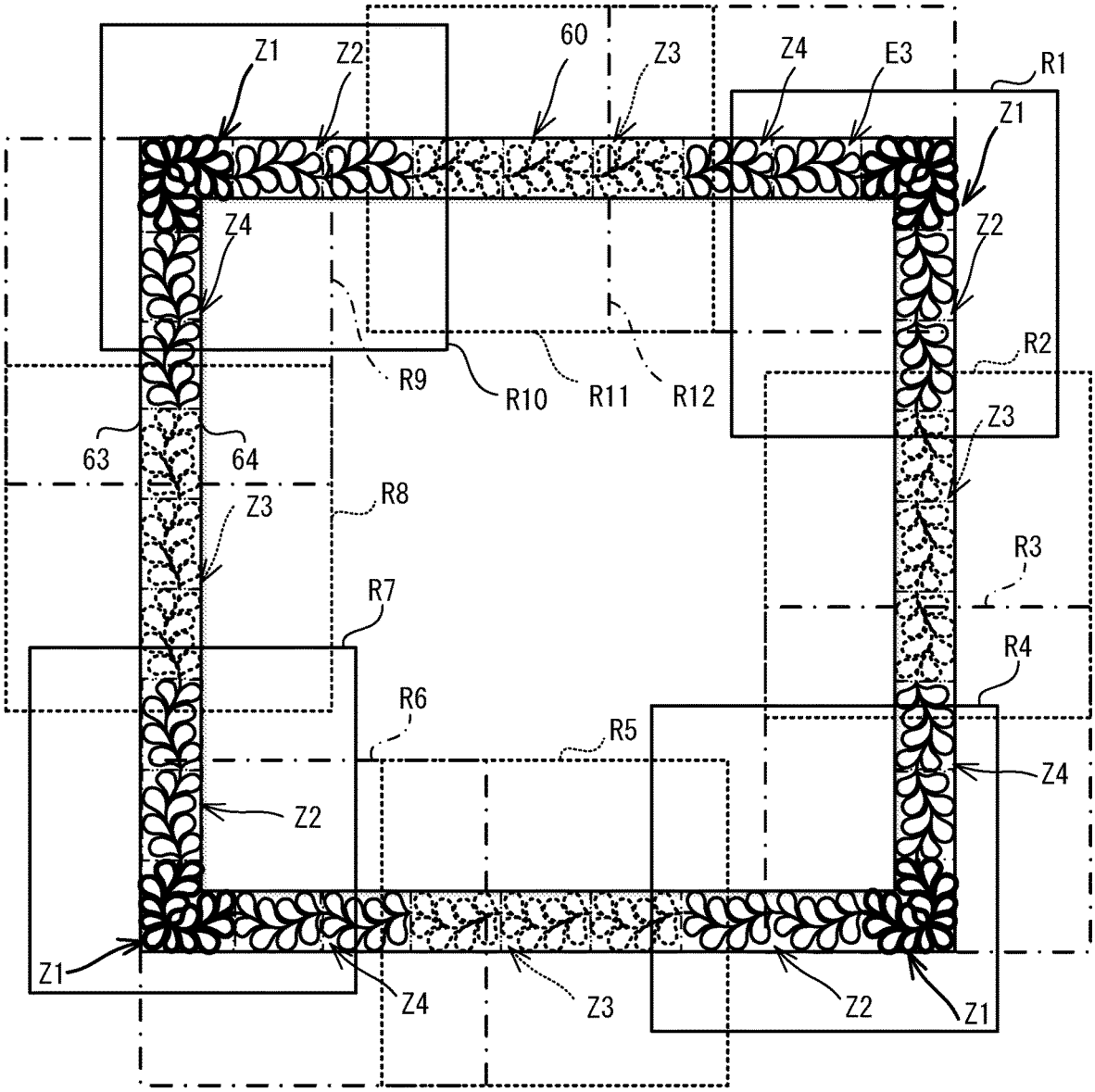
FIG. 5 is an explanatory diagram of the embroidery pattern arranged in the area, and the sewing area when the embroidery pattern is divided and sewn.

The processor 2 generates the embroidery data to sew the rectangular frame-shaped embroidery pattern (S5). For example, the processor 2 generates the embroidery data according to the following procedure. The processor 2 enlarges or contracts the first pattern E1 such that the lengths corresponding to the lengths W1 and H1 of the first pattern E1 acquired at S1 become the lengths G and J calculated using Equation (2) and Equation (3). Then, the processor 2 rotates the first pattern E1 appropriately and arranges the first pattern E1 in each of the four corner portions 61. With respect to the side portion 62 extending in the X direction, the processor 2 enlarges or contracts the second pattern E2 such that the lengths corresponding to the lengths W2 and H2 of the second pattern E2 acquired at S1 become the lengths W and FX, respectively. Then, the processor 2 arranges the number NX of the enlarged or contracted second patterns E2 in the X direction. With respect to the side portion 62 extending in the Y direction, the processor 2 enlarges or contracts the second pattern E2 such that the lengths corresponding to the lengths W2 and H2 of the second pattern E2 acquired at S1 become the lengths W and FY, respectively. Then, the processor 2 arranges the number NY of the enlarged or contracted second patterns E2 in the Y direction. The end point EP1 of the first pattern E1 matches the start point SP2 of the second pattern E2 adjacent to the end point EP1. The end point EP2 of the second pattern E2 matches the start point SP2 of the second pattern E2 adjacent to the end point EP2, or the start point SP1 of the first pattern E1. The processor 2 arranges each of the patterns so that the start point and the end point of each of the patterns are connected sequentially in the clockwise direction, taking the first pattern E1 arranged at the upper right of FIG. 5 as a reference. As shown in FIG. 5, an embroidery pattern E3 formed by the first patterns E1 and the second patterns E2 arranged according to the above-described procedure is a pattern that is represented by a single continuous line as a whole.

When the embroidery pattern E3 is not contained within the sewing area R, the processor 2 divides the embroidery pattern E3 into partial patterns having a size that is contained within the size of the sewing area R acquired at S3. The processor 2 of the present embodiment sets, as a sewing start point (a start point), the start point SP1 of the first pattern E1 arranged in the corner portion 61 in the X plus direction and the Y plus direction in the area 60, and causes the patterns (the first pattern E1 and the second pattern E2) to be sewn in the clockwise direction in a plan view, thus sewing the embroidery pattern E3. The processor 2 sets each of the first pattern E1 and the second pattern E2 as a minimum unit of the pattern to be divided. More specifically, the processor 2 divides the embroidery pattern E3 at one selected from the group of the start point SP1 and the end point EP1 of the first pattern E1, and the start point SP2 and the end point EP2 of the second pattern E2. The processor 2 may divide the embroidery pattern E3 such that the adjacent patterns (the first pattern E1 and the second pattern E2) are overlapped with each other by a few stitches. When the first pattern E1 is sewn after the second pattern E2, the sewing object C is re-stretched with respect to the embroidery frame 50, and the processor 2 sets the sewing area R such that the first pattern E1 is arranged in a posture in which the start point SP1 of the first pattern E1 is directed in the X minus direction and the end point EP1 of the first pattern E1 is directed in the Y minus direction. When the second pattern E2 is sewn, the processor 2 sets the sewing area R such that the sewing is performed such that the direction from the start point SP2 toward the end point EP2 of the second pattern E2 is the Y minus direction of the embroidery coordinate system.

As shown in FIG. 5, sewing areas R1 to R12 are set in a sewing order according to the above-described procedure, and the pattern data is generated for each of the sewing areas R1 to R12. The processor 2 sets, as the embroidery data, the data including the generated plurality of pattern data. In the sewing areas R1 to R3, the processor 2 generates the pattern data by defining the rightward direction and the upward direction in FIG. 5 as the X plus direction and the Y plus direction, respectively. In the sewing areas R4 to R6, the processor 2 generates the pattern data by defining the downward direction and the rightward direction in FIG. 5 as the X plus direction and the Y plus direction, respectively. In the sewing areas R7 to R9, the processor 2 generates the pattern data by defining the leftward direction and the downward direction in FIG. 5 as the X plus direction and the Y plus direction, respectively. In the sewing areas R10 to R12, the processor 2 generates the pattern data by defining the upward direction and the leftward direction in FIG. 5 as the X plus direction and the Y plus direction, respectively. The processor 2 arranges the partial patterns in the vicinity of the center of the sewing area R. The pattern data corresponding to the sewing areas R1, R4, R7 and R10 are two pieces of the pattern data, i.e., the pattern data to sew a pattern Z1 formed by the single first pattern E1, and the pattern data to sew a pattern Z2 including two of the second patterns E2. The pattern data corresponding to the sewing areas R2, R5, R8 and R11 includes the coordinate data to sew a pattern Z3 including three of the second patterns E2. The pattern data corresponding to the sewing areas R3, R6, R9 and R12 includes the coordinate data to sew a pattern Z4 including two of the second patterns E2. For each of the pattern data, the processor 2 generates graphic data of a graphic (a mask) indicating the size and position of the pattern, and stores the generated graphic data in association with the pattern data. The graphic corresponding to the pattern Z1 is the graphic D1, the graphic corresponding to the patterns Z2 and Z4 is a graphic D3 (refer to FIG. 12) to be described later, and the graphic corresponding to the pattern Z3 is a graphic D4 (refer to FIG. 14) to be described later. Each of the graphics D1, D3 and D4 is a rectangle having two sides that extend in the X direction and two sides that extend in the Y direction. The start point of each of the patterns Z2 to Z4 is the start point SP2 of the second pattern E2 that is first in the sewing order among the second patterns E2 included in the pattern. The end point of each of the patterns Z2 to Z4 is the end point EP2 of the second pattern E2 that is last in the sewing order among the second patterns E2 included in the pattern.

The processor 2 displays, on the LCD 15, a sewn image of the partial pattern that is included in the embroidery data and that corresponds to the sewing area R1 that is first in the sewing order. While referring to the LCD 15, the user causes the sewing object C to be held by the embroidery frame 50 such that a portion of the sewing object C corresponding to the sewing area R1 is within the sewing area R, and mounts the embroidery frame 50 on the holder 43.

The processor 2 sets a variable K to 1, and sets a variable N to 0 (S6). The variable K is a variable to read out the partial patterns for each of four side sections included in the rectangular frame-shaped area 60. In the present embodiment, as shown in FIG. 4C, in the area 60, a side section including the corner portion 61 located in the X plus direction and the Y plus direction and the side portion 62 that is continuous to the aforementioned corner portion 61 in the Y minus direction is a first side section, and second to fourth side sections are sequentially set in the clockwise direction from the first side section. The variable N is a variable to sequentially read out the partial patterns included in each of the side sections. The processor 2 performs arrangement setting processing relating to a first pattern E1 (K) that corresponds to the variable K (S7). The arrangement setting processing relating to the first pattern E1 (K) is processing to set the arrangement of a target pattern, taking the pattern Z1 (the first pattern E1) included in the K-th side section as the target pattern.

Figure 6:
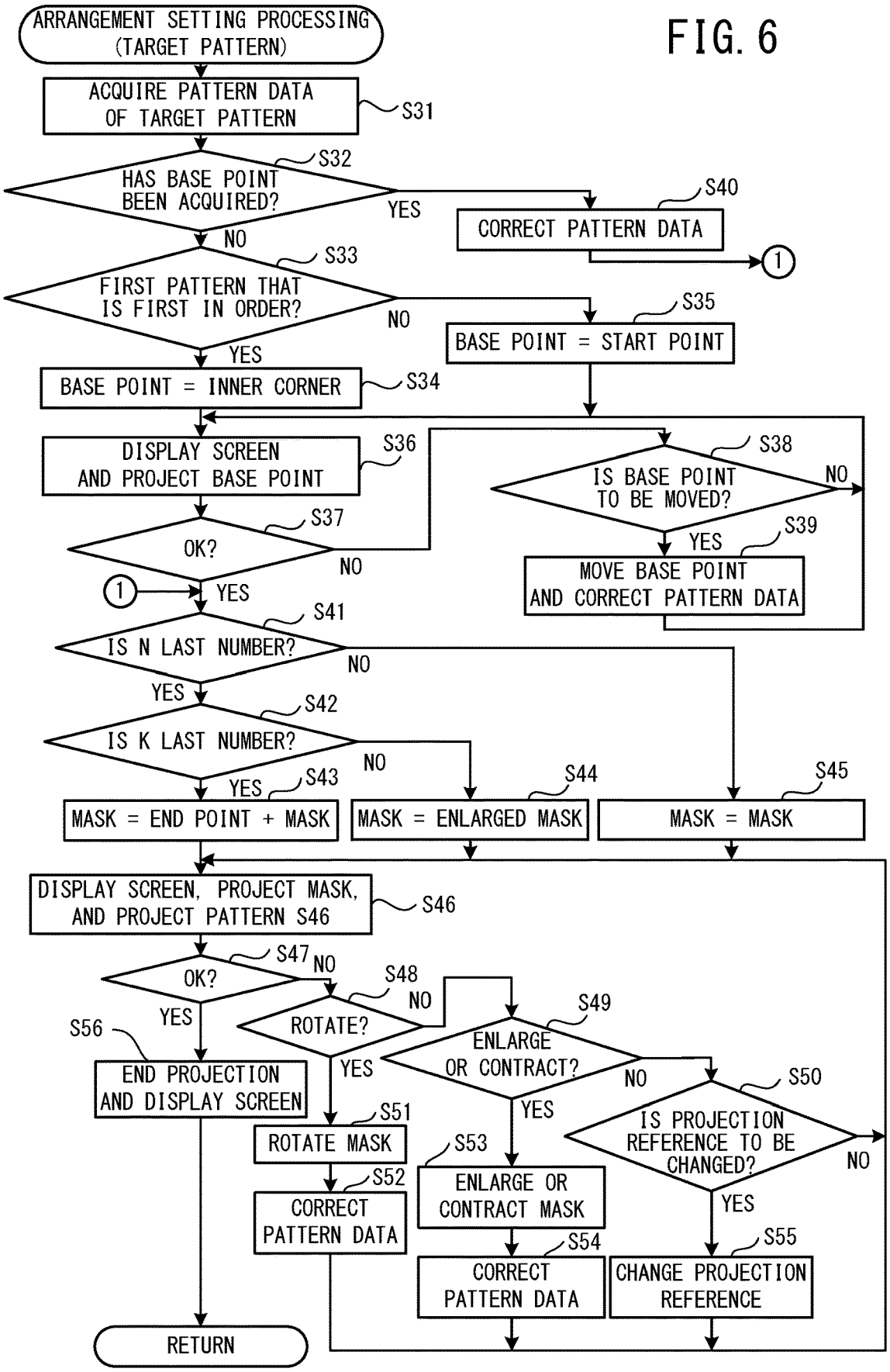
FIG. 6 is a flowchart of arrangement setting processing relating to a target pattern that is performed in the main processing shown in FIG. 3.

As shown in FIG. 6, in the arrangement setting processing, from among the plurality of pieces of pattern data included in the embroidery data generated at S5, the processor 2 acquires the pattern data of the target pattern Z1 and the graphic data (S31). The processor 2 determines whether the base point of the target pattern Z1 has been acquired (S32). The processor 2 determines that the base point of the target pattern Z1 has not been acquired (no at S32), and determines whether the target pattern Z1 is the first pattern E1 that is first in order (S33). In the specific example, it is determined that the target pattern Z1 is the first pattern E1 that is first in order (yes at S33), and the processor 2 sets the base point at an inside corner (S34). The processor 2 acquires a position of the point P4 of the graphic D1 that corresponds to the pattern data of the first pattern E1 acquired at S31. The position of the point P4 is indicated by a coordinate system of the movement portion 40.

Figure 7:
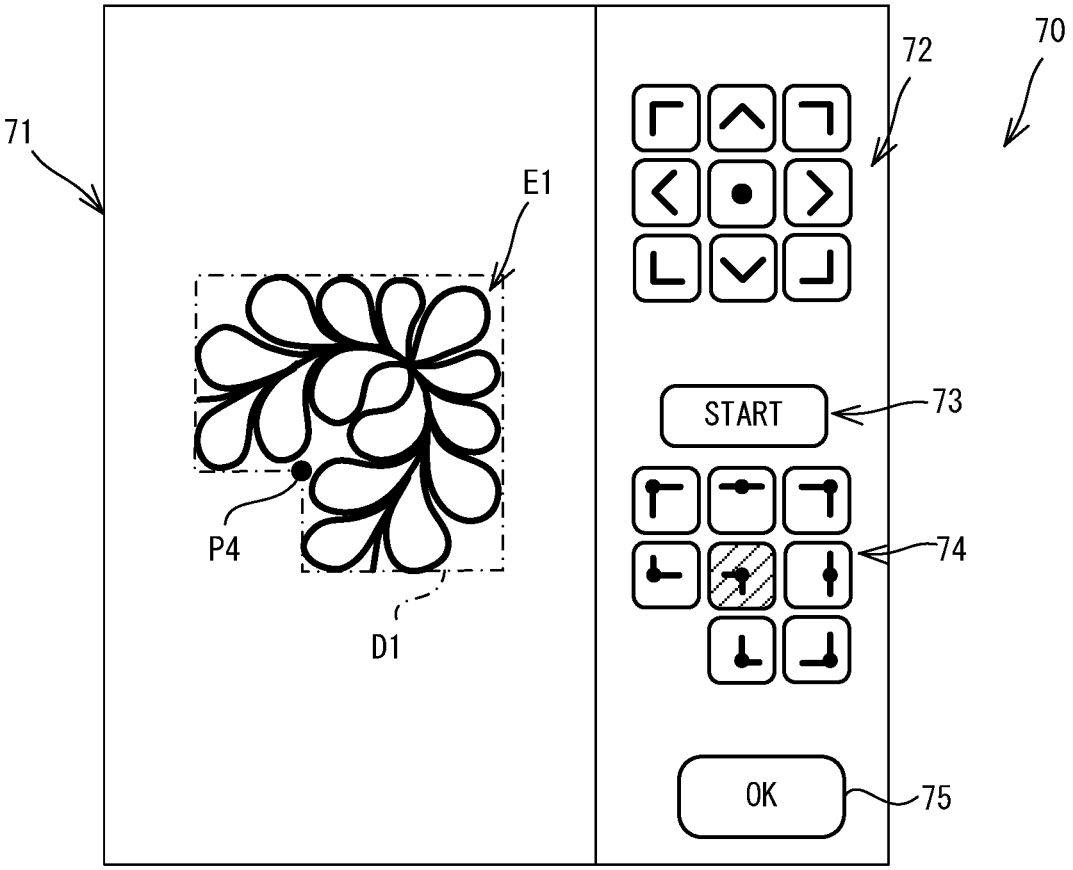
FIG. 7 is an explanatory diagram of a screen.

The processor 2 controls the LCD 15 and displays, on the LCD 15, a screen to specify the position of the base point P4 set at S34 (S36). For example, the processor 2 displays a screen 70 shown in FIG. 7 on the LCD 15. The screen 70 includes a display field 71, and keys 72 to 75. The display field 71 is used to display the sewn image of the target pattern, the base point set at S34 or S35, and a graphic representing the size of the target pattern. The keys 72 are depressed when moving the base point. The keys 73 and 74 are depressed when changing the base point. In FIG. 7, among the keys 73 and 74, the key indicating the point P4 that is being set as the base point is shown by diagonal hatching, and is displayed such that it can be distinguished from the other keys. The key 73 is depressed when setting the base point to the sewing start point of the target pattern. The keys 74 are depressed when setting the base point to a point on the graphic corresponding to the target pattern. The processor 2 of the present embodiment can select, as the base point, one selected from the group of the six points P1 to P6 of the graphic D1 corresponding to the first pattern E1, a midpoint between the point P1 and the point P2, or a midpoint between the point P1 and the point P6. The key 75 is depressed when the input of the position of the base point is complete.

Figure 8A:
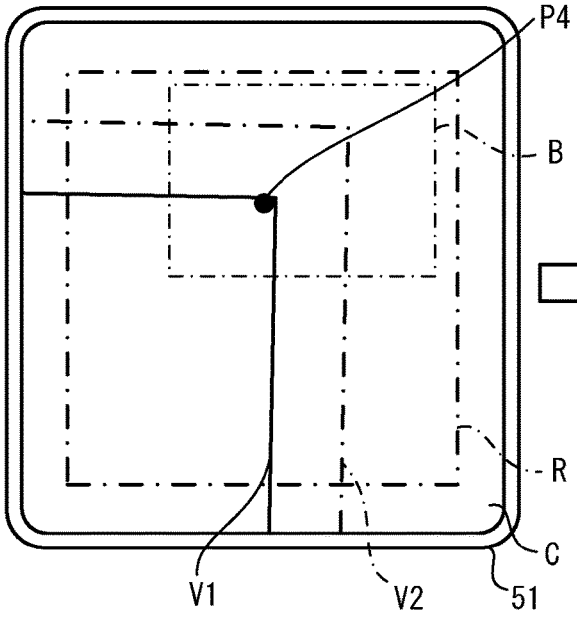
FIG. 8A is an explanatory diagram of a base point that is projected onto a sewing object held by a first frame.

The processor 2 controls the movement portion 40 and the projector 58, and projects the base point P4 set at S34 onto the sewing object C inside the sewing area R (S36). The processor 2 controls the movement portion 40 and moves the embroidery frame 50 to a position at which the position corresponding to the base point P4 set at S34 included in the pattern data acquired at S31 is substantially at the center of the projection area B. For example, as shown in FIG. 8A, the processor 2 projects the base point P4 onto the sewing object C. The processor 2 may be able to change a color, a size, a background color and the like of the base point P4 to be projected, in accordance with a color, a pattern and the like of the sewing object C. The processor 2 determines whether the depression of the keys 72 or the key 75 has been detected (S37, S38). The processor 2 continues this determination processing at S37 and S38 until the processor 2 detects the depression of the keys 72 or the key 75 (no at S37, no at S38).

Figure 8B:
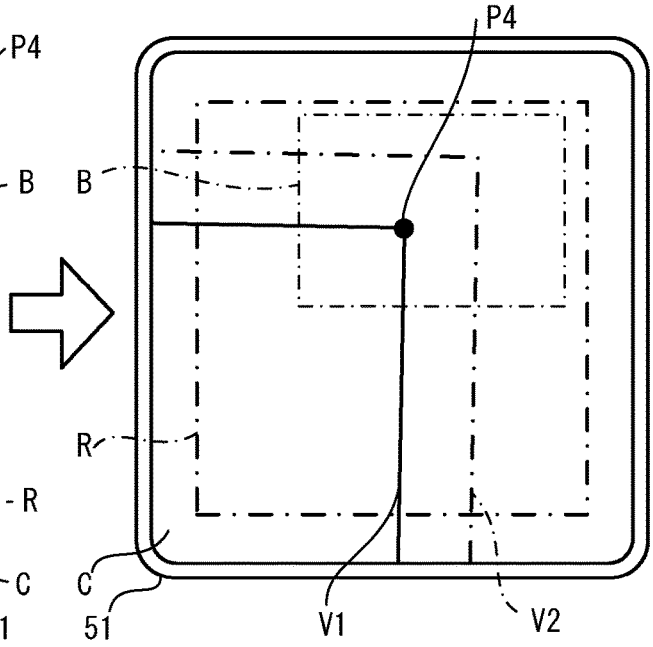
FIG. 8B is an explanatory diagram of a state in which the base point projected onto the sewing object is moved to a position that matches a corner of a line.
Figure 9:
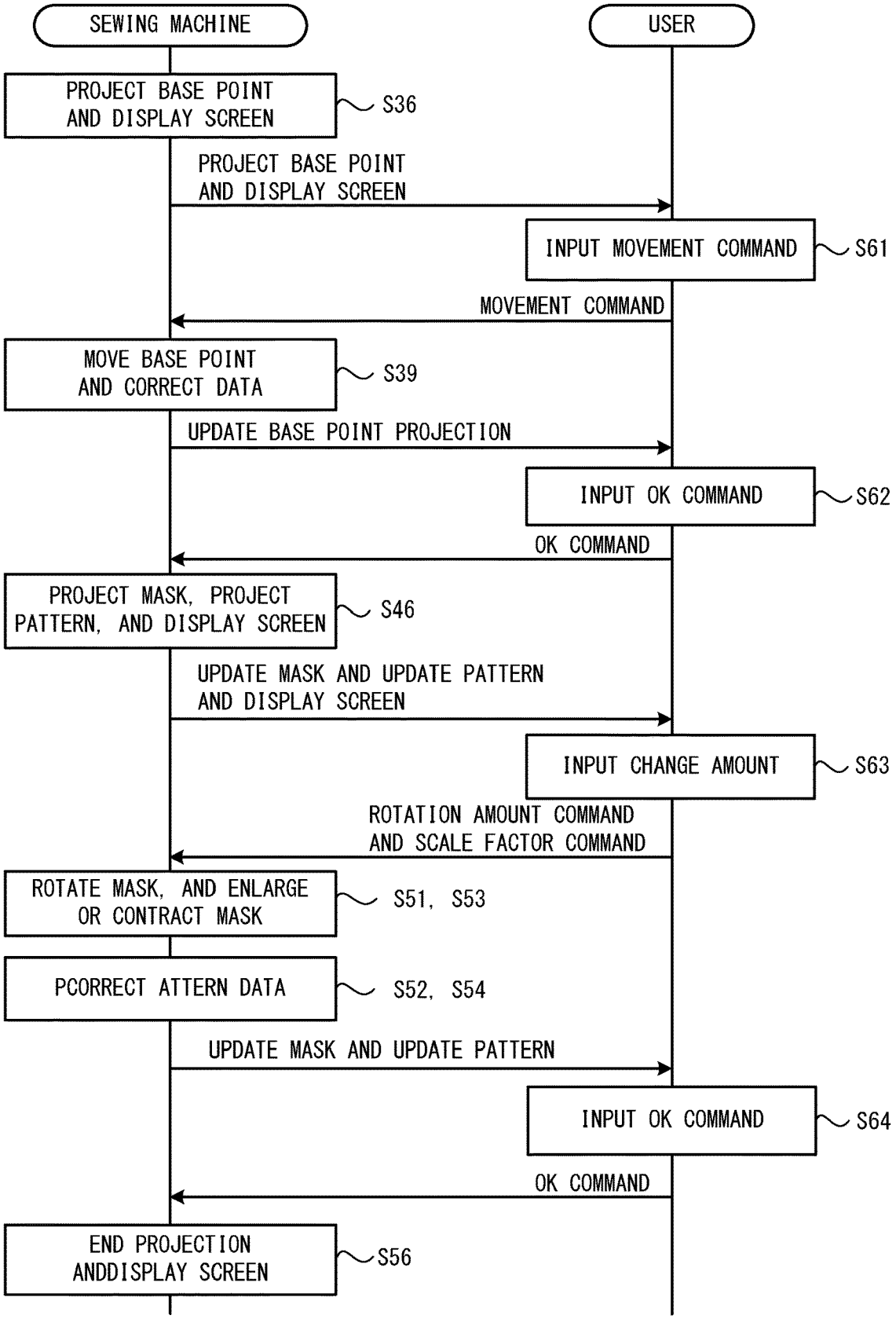
FIG. 9 is an explanatory diagram showing a correspondence between processing performed by the sewing machine and operations by a user, in a pattern alignment method.

As shown in FIG. 9, the user depresses the keys 72 and inputs a command to move the base point P4 so that the position of the projected base point P4 is aligned with a position of a reference graphic on the sewing object C held by the embroidery frame 50 (S61). For example, the reference graphic is a line V1 indicating the inner peripheral contour 64 of the area 60, or a line V2 indicating the outer peripheral contour 63. The lines V1 and V2 are drawn on the sewing object C using the tailor's chalk pen, for example. For example, the line V1 may be represented by cloth seams of a patchwork pattern sewn by combining a plurality of pieces of cloth. The user depresses the keys 72 so that the base point P4 projected onto the sewing object C is aligned with a corner of the line V1. As shown in FIG. 6 and FIG. 9, when the processor 2 detects the depression of the keys 72 (no at S37, yes at S38), the processor 2 moves the position of the base point P4 on the basis of the type of the keys 72 indicating a movement direction of the embroidery frame 50, and of a depression amount (a number of depressions or a depression continuation time period, for example) indicating a movement amount of the embroidery frame 50, and the processor 2 corrects the pattern data and the graphic data acquired at S31 in accordance with the movement amount of the base point P4 (S39). The processor 2 returns the processing to S36, controls the projector 58, and projects the base point 4 onto the corrected position (S36). As shown in FIG. 8B and FIG. 9, the user depresses the key 75 after confirming that the position of the projected base point P4 matches the position of the corner of the line V1 on the sewing object C held by the embroidery frame 50 (S62). As shown in FIG. 6 and FIG. 9, when the processor 2 detects the depression of the key 75 (yes at S37), the processor 2 determines whether the variable N is the last number corresponding to the variable K (S41). In the specific example, the last number of the variable N is 3 regardless of the variable K. Since the variable N corresponding to the target pattern Z1 is 0 (no at S41), the processor 2 sets, as a mask M1, the graphic D1 corresponding to the target pattern Z1 (the first pattern E1) (S45). The mask M is a graphic indicating the position and the size of the pattern represented by the pattern data.

Figure 11A:
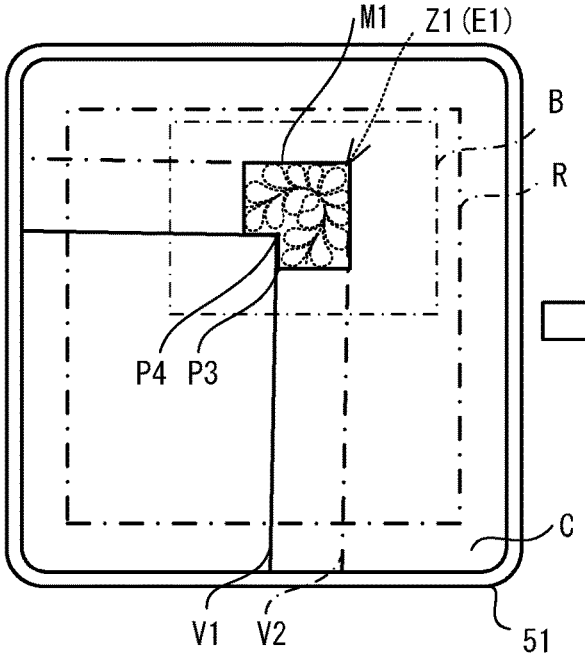
FIG. 11A is an explanatory diagram of a mask and the target pattern that are projected onto the sewing object held by the first frame.
Figure 11B:
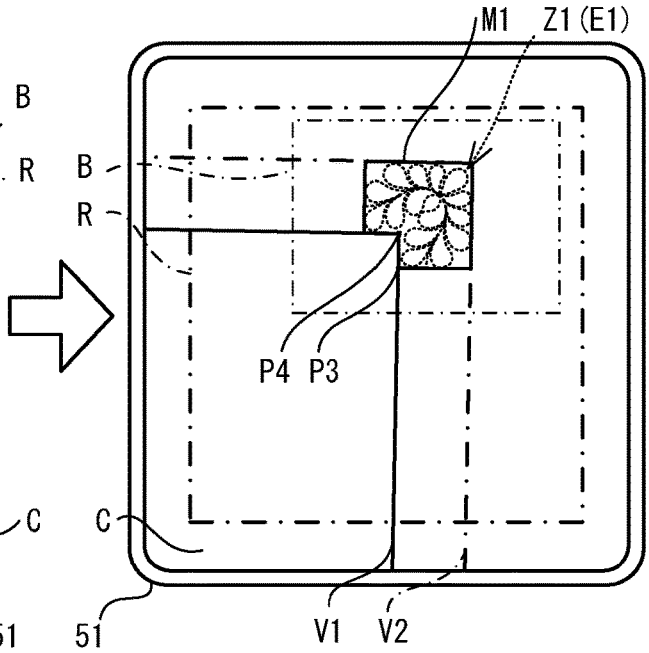
FIG. 11B is an explanatory diagram of a state in which the mask and the target pattern projected onto the sewing object are rotated around the base point to a position at which a point is arranged on a line.

The processor 2 controls the movement portion 40 and the projector 58, and projects the mask M set at one selected from the group of S43 to S45 onto the sewing object C inside the sewing area R (S46). More specifically, the processor 2 controls the movement portion 40 and moves the embroidery frame 50 to a position at which the set mask M1 is contained within the projection area B. When the whole of the mask M is not contained within the projection area B, the embroidery frame 50 is moved to a position at which a reference point of the mask M is contained within the projection area B. The reference point is a characteristic point (a vertex, for example) of the mask M, and is a point used for the alignment of the target pattern. The reference point of the target pattern Z1 is one of points on the mask M1, and is one of the point P2 or the point P3 on a side that is separated from the base point P4 in the Y minus direction. In the present embodiment, the reference point is the point P3 of the graphic D1 that is arranged on the inner peripheral contour 64. For example, as shown in FIG. 11A, the processor 2 projects the mask M1 and the target pattern Z1 (the first pattern E1) onto the sewing object C. In FIG. 11A and FIG. 11B, the first pattern E1 projected onto the sewing object C is shown by dotted lines.

The processor 2 controls the LCD 15 and displays a screen to instruct a change amount by which the positions of the plurality of needle drop points represented by the pattern data corrected at S39 are changed, using the acquired position of the point set at S34 or S35 as a base point whose position does not change before and after changing the positions of the plurality of needle drop points (S46). For example, the processor 2 displays a screen 80 shown in FIG.

Figure 10:
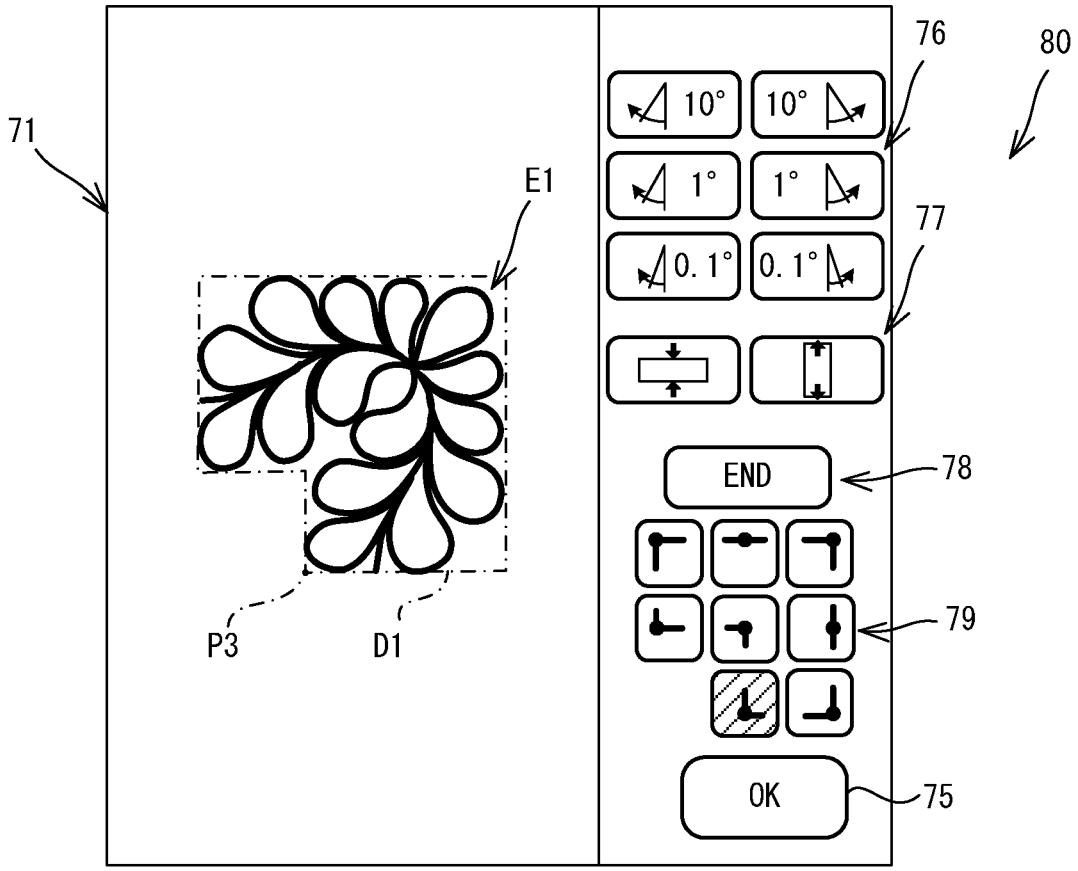
FIG. 10 is an explanatory diagram of a screen.

10. The screen 80 includes the display field 71, the key 75, and keys 76 to 79. The display field 71 is the same as the display field 71 of the screen 70. The keys 76 are depressed when specifying a rotation amount by which the arrangement of the target pattern is to be rotated around the set base point. The keys 77 are depressed when specifying a scale factor by which the target pattern is enlarged or contracted without changing the position of the base point. The keys 78 and 79 are depressed when changing the reference point. In FIG. 10, of the keys 78 and 79, the key indicating the point P3 that is being set as the base point is shown by diagonal hatching, and is displayed such that it can be distinguished from the other keys. The key 78 is depressed when setting the reference point as a sewing end point (an end point) of the target pattern. The keys 79 are depressed when setting the reference point to a point on the mask M1 corresponding to the target pattern. For example, the processor 2 can select one reference point from among eight points of the graphic D1 (the mask M1) corresponding to the target pattern Z1 (the first pattern E1), in the same manner as when the base point is selected using the keys 74 shown in FIG. 7. The key 75 is depressed when the setting of the reference point is complete. The processor 2 determines whether the depression of one selected from the group of the keys 75 to 79 has been detected (S47 to S50). The processor 2 continues the determination processing at S47 to S50 until the processor 2 detects the depression of one selected from the group of the keys 75 to 79 (no at S47, no at S48, no at S49, no at S50).

As shown in FIG. 9, the user depresses the keys 76 so that the position of the point P3 of the mask M1 projected onto the sewing object C is arranged on the line V1 on the sewing object C held by the embroidery frame 50, and inputs the rotation amount by which the arrangement of the pattern Z1 (the first pattern E1) is to be rotated using the point P4 as the base point (the center of rotation) (S63). As shown in FIG. 6 and FIG. 9, when the depression of the keys 76 is detected (no at S47, yes at S48), on the basis of the type of the keys 76 indicating the rotation direction and the rotation amount of the target pattern, the processor 2 corrects the graphic data representing the mask M1 to data representing the mask M1 that has been rotated around the point P4 (S51). The processor 2 corrects the pattern data acquired at S31, on the basis of the type of the keys 76 indicating the rotation direction and the rotation amount of the target pattern (S52). The processor 2 returns the processing to S46. As shown in FIG. 11B, the processor 2 projects the mask M1 on the basis of the graphic data corrected at S51, and projects the pattern Z1 on the basis of the pattern data corrected at S52 (S46). The mask M1 represented by the corrected graphic data is a rectangle having four sides that intersect the X direction and the Y direction. The user confirms that the position of the point P3 of the projected mask M1 is arranged on the line V1 on the sewing object C held by the embroidery frame 50 and that the pattern Z1 is arranged at a desired position with respect to the sewing object C as a result of the projected pattern Z1, as shown in FIG. 9. After that, the user depresses the key 75 (S64). As shown in FIG. 6 and FIG. 9, when the processor 2 detects the depression of the key 75 (yes at S47), the processor 2 ends the projection. After that, the processor 2 controls the LCD 15 and displays a message that prompts the user to input the sewing start command for the target pattern Z1 (S56). The processor 2 ends the arrangement setting processing relating to the first pattern E1 (K), and returns the processing to the main processing shown in FIG. 3.

The processor 2 determines whether the sewing start command has been detected (S8). The user depresses the start/stop switch 29 and inputs the sewing start command. When the sewing start command has not been detected (no at S8), the processor 2 continues the processing at S8 until the sewing start command is detected. When the sewing start command has been detected (yes at S8), the processor 2 drives the sewing portion 30 and the movement portion 40 to sew the pattern Z1 (the first pattern E1) on the sewing object C in accordance with the pattern data corrected at S7 (S39, S52), and drives the thread cutting mechanism to cut the threads (S9). The threads may be cut by the user. The processor 2 determines whether to change the position of the sewing object C with respect to the embroidery frame 50 and to re-stretch the sewing object C in order to sew the next target pattern (S10). Data indicating whether to re-stretch the sewing object C may be included in the embroidery data, for example. The processor 2 may determine that the sewing object C is to be re-stretched when the end point of the pre-correction target pattern Z1 indicated by the embroidery data does not match the start point of the next target pattern Z2. When it is determined that the sewing object C is to be re-stretched (yes at S10), the processor 2 controls the LCD 15 and displays a message that prompts the user to change the position of the sewing object C with respect to the embroidery frame 50 and to re-stretch the sewing object C (S11). Then, the processor 2 performs processing at S13 to be described later. In the specific example, the patterns corresponding to the sewing area R1 are two patterns, i.e., the pattern Z1 and the pattern Z2, and it is determined that the pattern Z2 can be sewn without changing the position of the sewing object C with respect to the embroidery frame 50 after the K-th first pattern E1 is sewn (no at S10). In this case, the processor 2 sets the base point of the pattern Z2 as a sewing start point P11, and sets the position of the end point of the first pattern E1 (K) that has already been sewn at the position of the base point P11 (S12).

The processor 2 adds 1 to the variable N (S13). The processor 2 performs the arrangement setting processing relating to a second pattern E2 (K, N) that corresponds to the variable K and the variable N (S14). The arrangement setting processing relating to the second pattern E2 (K, N) is processing to set the arrangement of the target pattern, taking one or more of the second patterns E2 included in the K-th side section as the target pattern. In the specific example, in the arrangement setting processing relating to a second pattern E2 (1, 1) when the variable K is 1 and the variable N is 1, the pattern Z2 in which the two second patterns E2 are arranged in the length direction of the second pattern E2 is used as the target pattern, and the arrangement of the target pattern is set. As shown in FIG. 6, the processor 2 acquires the pattern data to sew the pattern Z2 (S31), and determines that the base point P11 of the target pattern Z2 has already been acquired at S12 (yes at S32). The processor 2 moves the positions of the plurality of needle drop points represented by the pattern data of the target pattern Z2 acquired at S31, in accordance with a difference between the position of the sewing start point P11 represented by the pattern data and the position of the sewing start point P11 acquired at S12, and corrects the pattern data (S40). The processor 2 corrects the graphic data in accordance with the correction of the pattern data. The processor 2 determines that the variable N is 1 and that the variable N is not the last number corresponding to the variable K (no at S41), and sets, as a mask M2, the graphic D3 (to be described later) corresponding to the pattern Z2 (S45).

The processor 2 controls the LCD 15, and displays a screen to instruct a change amount by which the arrangement or the size of the target pattern Z2 is changed using the sewing start point P11 set at S12 as the base point (S46). For example, the processor 2 displays a screen 90 shown in FIG. 12. The screen 90 is different from the screen 80 shown in FIG. 10 in that the screen 90 includes keys 89 instead of the keys 79. The pattern Z2 and the graphic D3 are displayed in the display field 71. The graphic D3 is the smallest rectangle that encompasses the pattern Z4, and is represented by a point P7 to a point P10. The start point and the end point of the pattern Z2 are the point P11 and a point P12, respectively. The keys 89 are depressed when setting the reference point to a point on the mask M2 corresponding to the target pattern. In the present embodiment, the processor 2 can select one of the reference points from among the four vertices P7 to P10 on the mask M2 (the graphic D3) and midpoints of the respective sides. A default value of the reference point is at least one selected from the group of the point P9 and the point P8 at two corners, among four corners of the rectangular mask M2, that are in contact with a side separated from the start point P11 of the pattern Z2, and is the point P9 in the present embodiment.

Figure 13A:
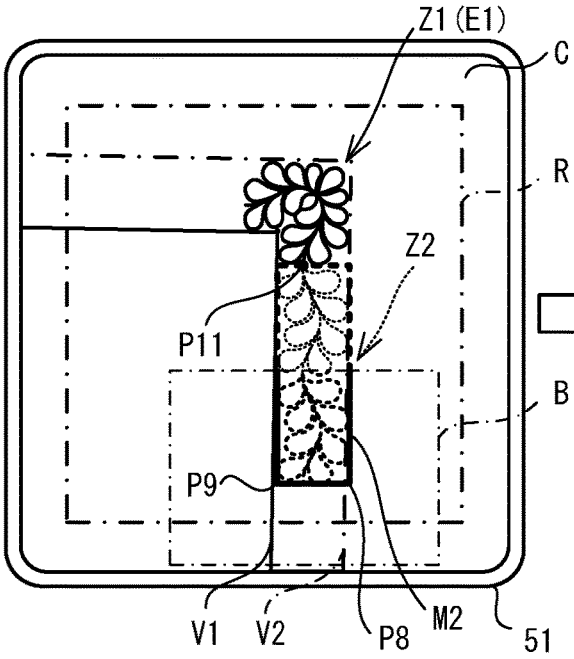
FIG. 13A is an explanatory diagram of a mask and a target pattern projected onto the sewing object held by the first frame.

The processor 2 controls the movement portion 40 and the projector 58, and projects the mask M2 set at S45 and the target pattern Z2 onto the sewing object C inside the sewing area R, as shown in FIG. 13A, for example (S46). Specifically, the processor 2 controls the movement portion 40 and moves the embroidery frame 50 to a position at which the set mask M2 is contained within the projection area B. In the specific example, since the whole of the mask M2 is not contained within the projection area B, the processor 2 moves the embroidery frame 50 to a position at which the reference point P9 of the mask M2 is contained within the projection area B, and projects a part of the mask M2 and a part of the target pattern Z2 onto the sewing object C. In FIG. 13, the pattern Z1 (the first pattern E1) that has already been sewn on the sewing object C is shown by solid lines, the projected part of the pattern Z2 is shown by thick dotted lines, and the other part of the pattern Z2 that is on the outside of the projection area B is shown by thin dotted lines. The mask M2 projected inside the projection area B includes positions of the points P8 and P9 at the two corners, among the four corners of the mask M2, that are in contact with the side (the side connecting the point P9 and the P8) separated from the start point P11.

Figure 13B:
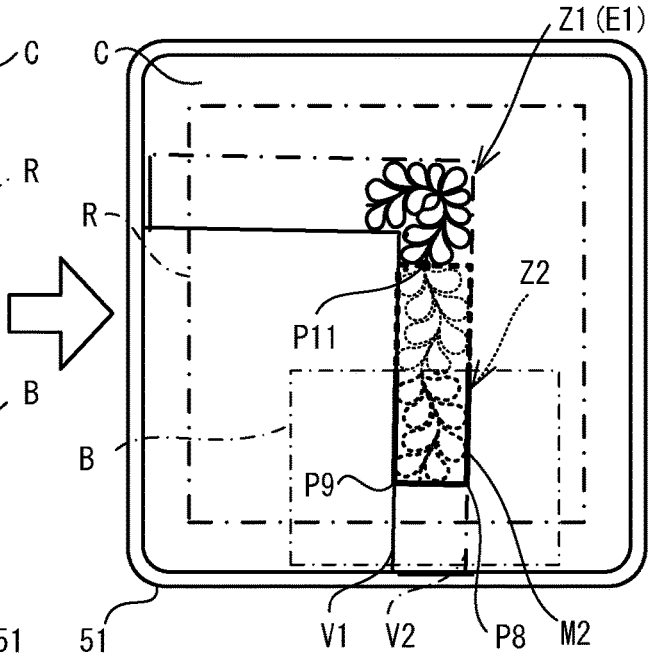
FIG. 13B is an explanatory diagram of a state in which the mask and the target pattern projected onto the sewing object are rotated around the base point to a position at which a point is arranged on a line.

The user depresses the keys 76 so that the position of the point P9 of the mask M2 projected onto the sewing object C is arranged on the line V1 on the sewing object C held by the embroidery frame 50, and inputs a rotation amount by which the arrangement of the pattern Z2 is to be rotated using the point P11 as the base point (the center of rotation) (S63). When the depression of the keys 76 is detected (no at S47, yes at S48), on the basis of the type of the keys 76 indicating the rotation direction and the rotation amount of the target pattern Z2, the processor 2 corrects the graphic data representing the mask M2 so that the mask M2 is rotated around the point P11 (S51). Further, the processor 2 corrects the pattern data of the target pattern Z2 corrected at S40, on the basis of the type of the keys 76 indicating the rotation direction and the rotation amount of the target pattern Z2 (S52). The processor 2 returns the processing to S46. As shown in FIG. 13B, the processor 2 projects the mask M2 on the basis of the graphic data corrected at S51, and projects the pattern Z2 on the basis of the pattern data corrected at S52 (S46). When the user wants to confirm the arrangement of a part of the mask M2 and a part of the target pattern Z that are not projected onto the sewing object C, the user depresses the keys 89 and issues a command to change the reference point. When the processor 2 detects the depression of the keys 89 (no at S47, no at S48, no at S49, yes at S50), the processor 2 sets, as the reference point, a point specified using the keys 89 (S55). The processor 2 controls the movement portion 40 and the projector 58, and projects a part of the mask M2 and a part of the target pattern Z2 that correspond to the set reference point onto the sewing object C (S46). The user confirms that the position of the point P9 of the projected mask M2 is arranged on the line V1 on the sewing object C held by the embroidery frame 50 and that the pattern Z2 is arranged at a desired position with respect to the sewing object C as a result of the projected pattern Z2, and thereafter depresses the key 75 (S64). When the processor 2 detects the depression of the key 75 (yes at S47), the processor 2 ends the projection. After that, the processor 2 controls the LCD 15 and displays a message that prompts the user to input the sewing start command (S56). The processor 2 ends the arrangement setting processing relating to the second pattern E2 (1, 1) when the variable K is 1 and the variable N is 1, and returns the processing to the main processing shown in FIG. 3.

The processor 2 determines whether the sewing start command has been detected (S15). The processor 2 continues the processing at S15 until the sewing start command is detected (no at S15). The user depresses the start/stop switch 29 and inputs the sewing start command. When the sewing start command has been detected (yes at S15), the processor 2 drives the sewing portion 30 and the movement portion 40 to sew the pattern Z2 on the sewing object C in accordance with the pattern data corrected at S14, and drives the thread cutting mechanism to cut the threads (S16). The threads may be cut by the user. The processor 2 determines whether the variable N is the last number corresponding to the variable K (S17). When the variable N is not the last number corresponding to the variable K (no at S17), the processor 2 controls the LCD 15 and displays a message that prompts the user to change the position of the sewing object C with respect to the embroidery frame 50 and to re-stretch the sewing object C (S18). The processor 2 returns the processing to S13. The processor 2 adds 1 to the variable N (S13).

The processor 2 performs the arrangement setting processing relating to a second pattern E2 (1, 2) when the variable K is 1 and the variable N is 2 (S14). The processor 2 uses, as the target pattern, the pattern Z3 in which three of the second patterns E2 are arranged in the length direction of the second pattern E2, and the arrangement of the target pattern is set. As shown in FIG. 6, the processor 2 acquires the pattern data to sew the pattern Z3 (S31), and determines that the base point of the target pattern Z3 has not been acquired at S12 (no at S32). It is determined that the target pattern Z3 is not the first pattern E1 that is first in order (no at S33), and the processor 2 sets a start point P17 (refer to FIG. 14) of the target pattern Z3 as the base point (S35).

Figure 12:
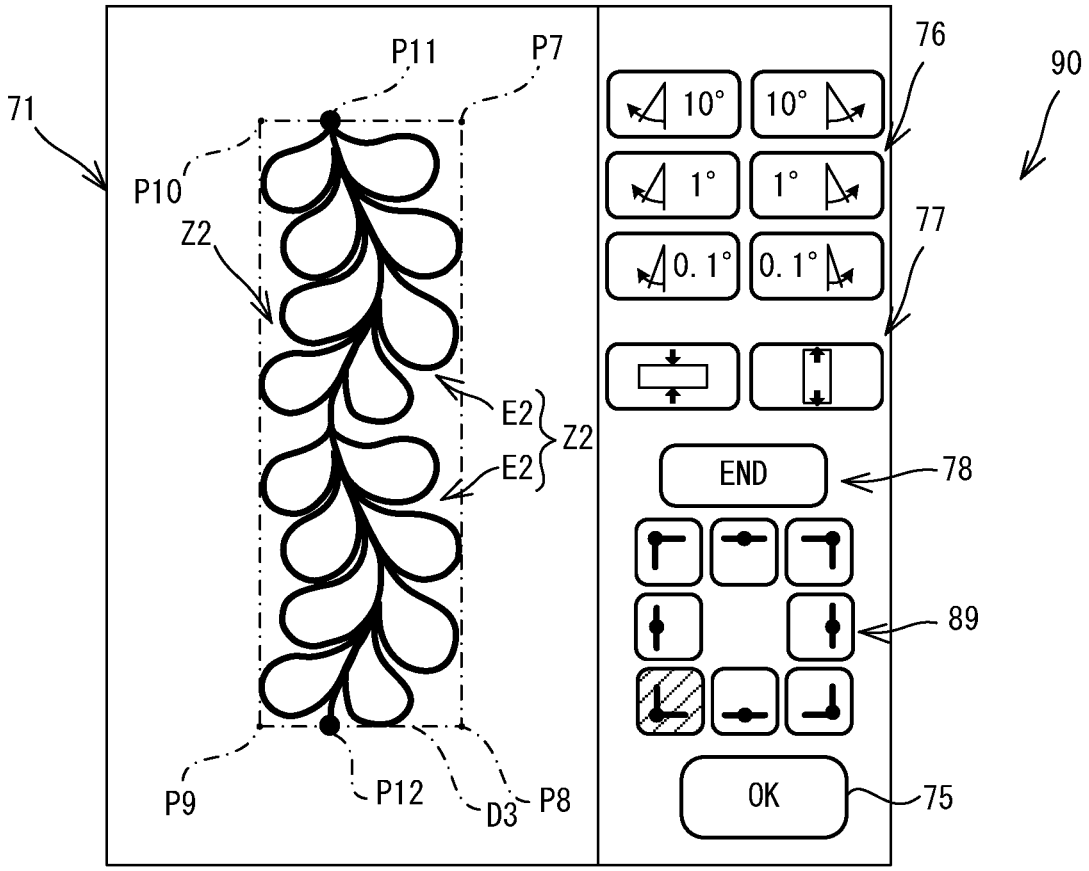
FIG. 12 is an explanatory diagram of a screen.
Figure 14:
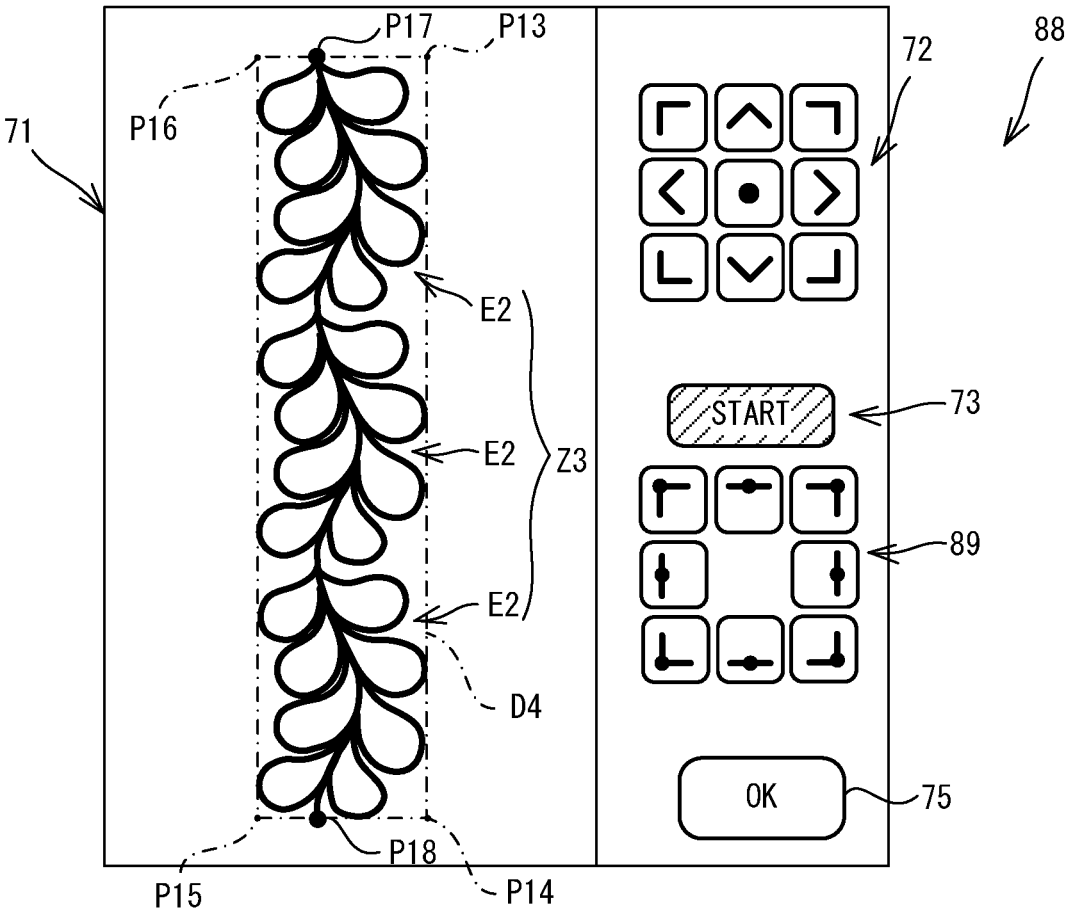
FIG. 14 is an explanatory diagram of a screen.
Figure 15A:
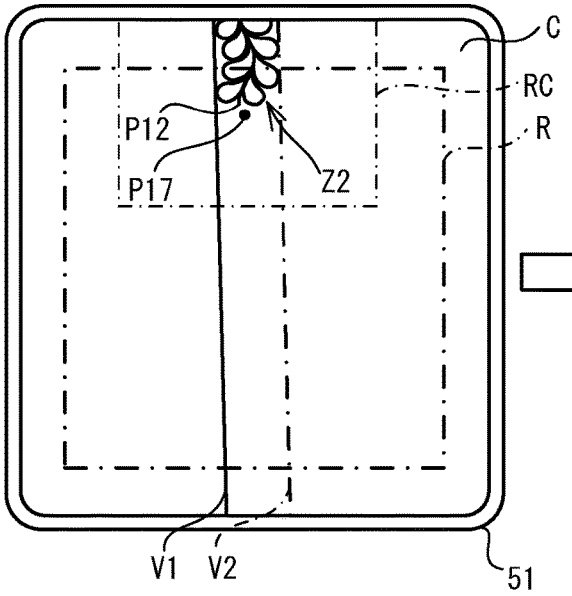
FIG. 15A is an explanatory diagram of the base point projected onto the sewing object held by the first frame.
Figure 15B:
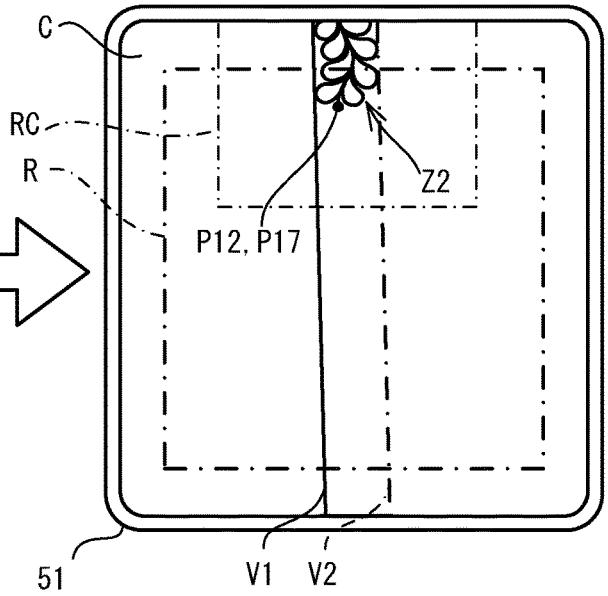
FIG. 15B is an explanatory diagram of a state in which the base point projected onto the sewing object is moved to a position at which the base point projected onto the sewing object matches an end point of the pattern.

The processor 2 controls the LCD 15 and displays, on the LCD 15, the base point P17 set at S35 (S36). For example, the processor 2 displays a screen 88 shown in FIG. 14. The screen 88 is different from the screen 70 shown in FIG. 7 in that the keys 89 that are the same as the keys 89 in FIG. 12 are displayed instead of the keys 74. The keys 89 are depressed when changing the base point. In FIG. 14, of the keys 73 and 89, the key 73 indicating the point P17 that is being set as the base point is shown by diagonal hatching, and is displayed such that it can be distinguished from the other keys 89. As shown in FIG. 15A, the processor 2 controls, for example, the movement portion 40 and moves the embroidery frame 50 to a position at which the base point P17 set at S35 is substantially at the center of the projection area B. Then, the processor 2 controls the projector 58 and projects the base point P17 onto the sewing object C (S36). As shown in FIG. 9, the user depresses the keys 72 so that the position of the projected base point P17 is aligned with the position of the end point P12 of the pattern Z2 on the sewing object C held by the embroidery frame 50, and inputs a command to move the base point P17 (S61). As shown in FIG. 6 and FIG. 9, when the processor 2 detects the depression of the keys 72 (no at S37, yes at S38), the processor 2 moves the positions of the plurality of needle drop points represented by the pattern data, by the movement amount that corresponds to the type of the keys 72 indicating the movement direction of the embroidery frame 50 and the depression amount indicating the movement amount of the embroidery frame 50, and corrects the pattern data (S39). The processor 2 corrects the graphic data in accordance with the correction of the pattern data. The processor 2 returns the processing to S36. As shown in FIG. 9 and FIG. 15B, the user confirms that the position of the projected base point P17 is aligned with the end point P12 of the pattern Z2 that has already been sewn on the sewing object C held by the embroidery frame 50. After that, the user depresses the key 75 (S62). As shown in FIG. 6, when the processor 2 detects the depression of the key 75 (yes at S37), the processor 2 determines that the variable N is not the last number corresponding to the variable K (no at S41), and sets the graphic D4 as a mask M3 (S45). As shown in FIG. 14, the graphic D4 is the smallest rectangle that encompasses the pattern Z3, and is represented by four vertices P13 to P16. The start point and the end point of the pattern Z3 are the point P17 and a point P18, respectively.

Figure 16A:
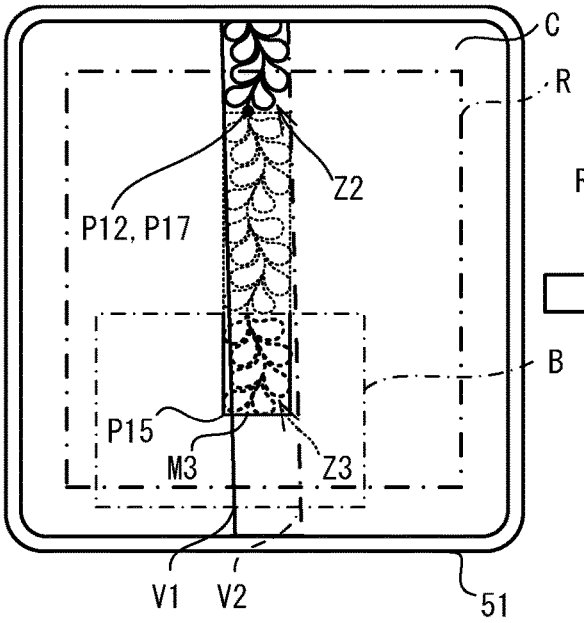
FIG. 16A is an explanatory diagram of a mask and a target pattern that are projected onto the sewing object held by the first frame.
Figure 16B:
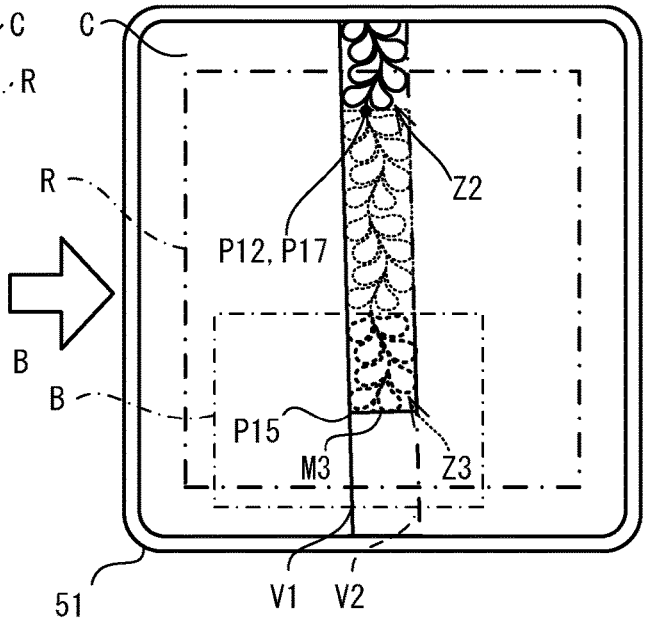
FIG. 16B is an explanatory diagram of a state in which the mask and the target pattern projected onto the sewing object are rotated around the base point to a position at which a point is arranged on a line.

The processor 2 controls the LCD 15 and displays a screen to instruct a change amount by which the arrangement of the target pattern Z3 is changed using the point P17 set at S35 as the base point (S46). For example, the processor 2 displays a screen displaying the pattern Z3 and the graphic D4 in the display field 71 of the screen 88 shown in FIG. 14. The processor 2 controls the movement portion 40 and the projector 58 and, for example, as shown in FIG. 16A, projects a part of the mask M3 set at S45 and a part of the target pattern Z3 onto the sewing object C inside the sewing area R (S46). In FIG. 16A and FIG. 16B, the pattern Z2 that has already been sewn on the sewing object C is shown by solid lines, the projected part of the pattern Z3 is shown by thick dotted lines, and the projected part of the mask M3 is shown by thick solid lines. The other part of the pattern Z3 that is on the outside of the projection area B is shown by thin dotted lines, and the other part of the mask M3 that is on the outside of the projection area B is shown by dotted lines.

As shown in FIG. 9, the user depresses the keys 76 so that the position of the point P15 of the mask M3 projected onto the sewing object C is arranged on the line V1 on the sewing object C held by the embroidery frame 50, and inputs a rotation amount by which the arrangement of the pattern Z3 is rotated using the point P17 as the base point (the center of rotation) (S63). As shown in FIG. 6 and FIG. 9, when the depression of the keys 76 is detected (no at S47, yes at S48), on the basis of the type of the keys 76 indicating the rotation direction and the rotation amount of the target pattern Z3, the processor 2 corrects the graphic data representing the mask M3 so that the mask M3 is rotated around the point P17 (S51), and corrects the pattern data of the target pattern Z3 acquired at S31 (S52). The processor 2 returns the processing to S46. As shown in FIG. 16B, the processor 2 projects a part of the mask M3 on the basis of the graphic data corrected at S51, and projects a part of the pattern Z3 on the basis of the pattern data corrected at S52 (S46). As shown in FIG. 9, the user confirms that the position of the point P15 of the projected mask M3 is arranged on the line V1 on the sewing object C held by the embroidery frame 50, and thereafter depresses the key 75 (S64). As shown in FIG. 6 and FIG. 9, when the processor 2 detects the depression of the key 75 (yes at S47), the processor 2 ends the projection. After that, the processor 2 controls the LCD 15 and displays the message that prompts the user to input the sewing start command (S56). The processor 2 ends the arrangement setting processing relating to the second pattern E2 (1, 2) when the variable K is 1 and the variable N is 2, and returns the processing to the main processing shown in FIG. 3. When the sewing start command has been detected (yes at S15), the processor 2 drives the sewing portion 30 and the movement portion 40 to sew the pattern Z3 on the sewing object C in accordance with the pattern data corrected at S14, and drives the thread cutting mechanism to cut the threads (S16). The processor 2 determines that the variable N is not the last number corresponding to the variable K (no at S17). The processor 2 controls the LCD 15 and displays the message that prompts the user to change the position of the sewing object C with respect to the embroidery frame 50 and to re-stretch the sewing object C (S18). The processor 2 returns the processing to S13 and adds 1 to the variable N (S13).

Figure 17:
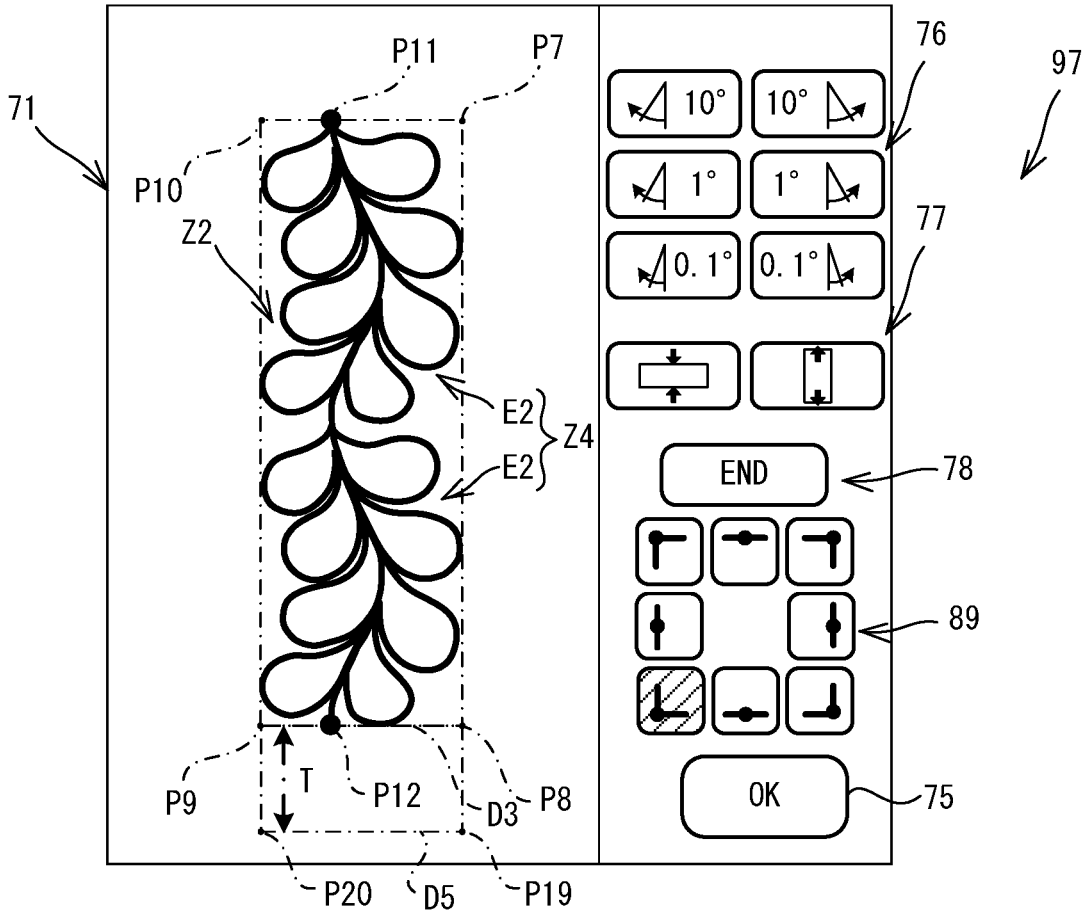
FIG. 17 is an explanatory diagram of a screen.

The processor 2 performs the arrangement setting processing relating to a second pattern E2 (1, 3) when the variable K is 1 and the variable N is 3 (S14). The second pattern E2 (1, 3) when the variable K is 1 and the variable N is 3 corresponds to a case of sewing the pattern Z4 including the second pattern E2 that is arranged in the side portion 62 of the area 60 and that is last in the sewing order. In the same manner as the arrangement setting processing relating to the second pattern E2 (1, 2) when the variable K is 1 and the variable N is 2, in the arrangement setting processing relating to the second pattern E2 (1, 3) when the variable K is 1 and the variable N is 3, the position of the base point is set using the start point P11 of the target pattern Z4 as the base point (S31 to S39). When the processor 2 detects the depression of the key 75 (yes at S37), the processor 2 determines that the variable N is the last number corresponding to the variable K (yes at S41). The processor 2 determines whether the variable K is the last number (namely, 4) (S42). In the specific example, it is determined that the variable K is not the last number (no at S42), and the processor 2 sets, as a mask M4, the graphic D5 indicating an enlarged mask (S44). As shown in FIG. 17, the enlarged mask is the rectangular graphic D5 obtained by enlarging the graphic D3, which corresponds to the target pattern Z4, by a length T in the length direction (the Y minus direction) of the target pattern Z4. The length T corresponds to a distance between the point P4 and the point P5 of the graphic D1 corresponding to the first pattern E1. The distance between the point P4 and the point P5 is a value obtained by subtracting the length W3 from the length W1. Since the pattern Z4 includes the two second patterns E2, the length of the enlarged mask in the width direction is the length W, and a length FS of the enlarged mask in the length direction is calculated using, for example, Expression (8) or Expression (9), in accordance with the extending direction of the side portion 62 in which the pattern Z4 is arranged.

$$FS=(W1-W3)\times W/W3+FX\times 2 \quad \text{Expression (8)}$$

$$FS=(W1-W3)\times W/W3+FY\times 2 \quad \text{Expression (9)}$$

Figure 18A:
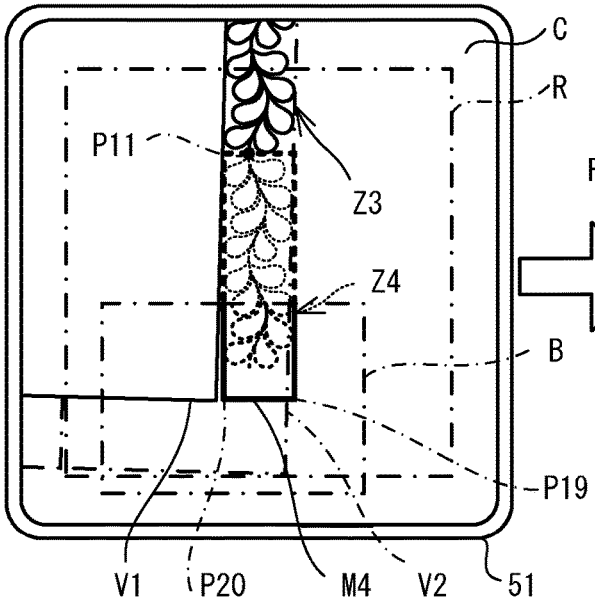
FIG. 18A is an explanatory diagram of a mask and a target pattern that are projected onto the sewing object held by the first frame.
Figure 18B:
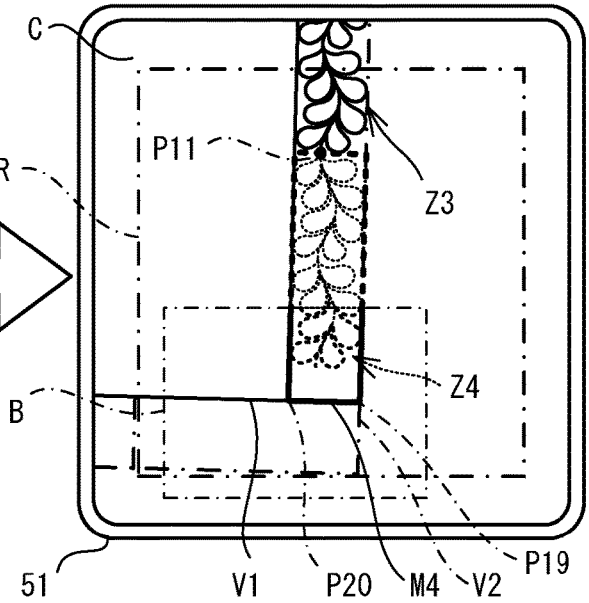
FIG. 18B is an explanatory diagram of a state in which the mask and the target pattern projected onto the sewing object are rotated around the base point to a position at which a point is arranged on a line, and are enlarged or contracted without changing a position of the base point.
Figure 19:
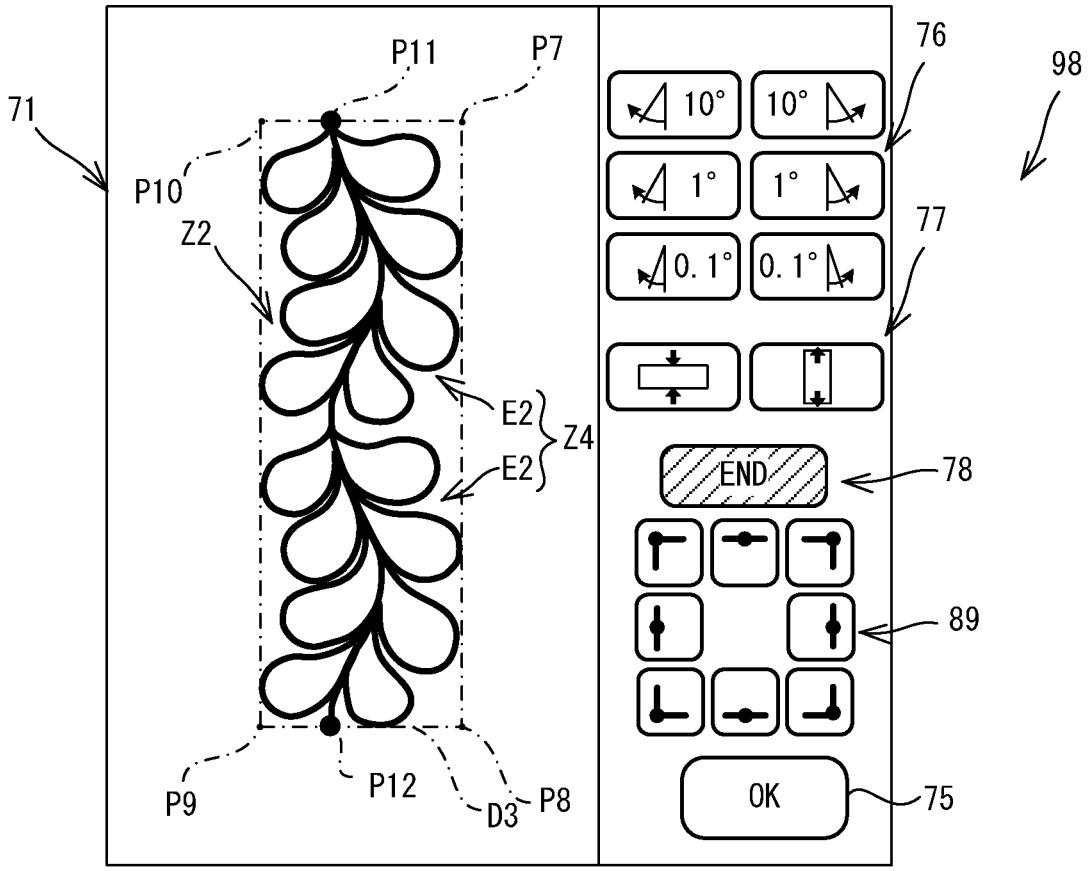
FIG. 19 is an explanatory diagram of a screen.

The processor 2 controls the LCD 15 and displays a screen to instruct a change amount by which the arrangement of the target pattern Z4 is changed using the point P11 set at S35 as the base point (S46). For example, the processor 2 displays a screen 97 shown in FIG. 17. The screen 97 is the same as the screen 90 shown in FIG. 12. The enlarged mask M4 is a rectangle whose vertices are the point P7, a point P19, a point P20 and the point P10. The keys 89 are depressed when setting the reference point to a point on the enlarged mask M4 corresponding to the target pattern Z4. The processor 2 controls the movement portion 40 and the projector 58, and projects a part of the mask M4 set at S45 and a part of the target pattern Z4 onto the sewing object C inside the sewing area R, as shown in FIG. 18A, for example (S46). In FIG. 18A and FIG. 18B, the pattern Z3 that has already been sewn on the sewing object C is shown by solid lines, the projected part of the pattern Z4 is shown by thick dotted lines, and the projected part of the mask M4 is shown by thick solid lines. The other part of the pattern Z4 that is on the outside of the projection area B is shown by thin dotted lines, and the other part of the mask M4 that is on the outside of the projection area B is shown by dotted lines. As shown in FIG. 18A and FIG. 18B, the projected part of the mask M4 includes the point P20 and the point P19. The point P20 corresponds to the position of a point P65 at the inner corner of the corner portion 61 which is one of the four corner portions 61 of the area 60 and in which the first pattern E1 adjacent to the second pattern E2 is arranged.

The user depresses the keys 76 so that the position of the point P20 of the mask M4 projected onto the sewing object C is aligned with the corner of the line V1 on the sewing object C held by the embroidery frame 50, and inputs a rotation amount by which the arrangement of the pattern Z4 is rotated using the point P11 as the base point (the center of rotation) (S63). When the depression of the keys 76 is detected (no at S47, yes at S48), on the basis of the type of the keys 76 indicating the rotation direction and the rotation amount of the target pattern, the processor 2 corrects the graphic data representing the mask M4 so that the mask M4 is rotated around the point P11 (S51), and corrects the pattern data of the target pattern Z4 acquired at S31 (S52). The processor 2 returns the processing to S46. The processor 2 projects a part of the mask M4 on the basis of the graphic data corrected at S51, and projects a part of the pattern Z4 on the basis of the pattern data corrected at S52 (S46).

When, by simply rotating the pattern Z4 around the point P11, the position of the point P20 of the mask M4 cannot be aligned with the corner of the line V1 on the sewing object C held by the embroidery frame 50, the user depresses the keys 77 so that the position of the point P20 of the mask M4 projected onto the sewing object C is aligned with the corner of the line V1 on the sewing object C held by the embroidery frame 50. The user inputs a scale factor by which the pattern Z4 is enlarged or contracted in the length direction of the pattern Z4 using the point P11 as the base point (S63). When the depression of the keys 77 is detected (no at S47, no at S48, yes at S49), the processor 2 corrects the graphic data representing the mask M4 so that the mask M4 is enlarged or contracted using the point P11 as the base point, on the basis of the type and the depression amount of the keys 77 (S53), and corrects the pattern data of the target pattern Z4 acquired at S31 (S54). The processor 2 returns the processing to S46. As shown in FIG. 18B, the processor 2 projects a part of the mask M4 on the basis of the graphic data corrected at S51, and projects a part of the pattern Z4 on the basis of the pattern data corrected at S52 (S46).

The user confirms that the position of the point P20 of the projected mask M4 is aligned with the corner of the line V1 on the sewing object C held by the embroidery frame 50, and thereafter depresses the key 75 (S64). When the processor 2 detects the depression of the key 75 (yes at S47), the processor 2 ends the projection. After that, the processor 2 controls the LCD 15 and displays the message that prompts the user to input the sewing start command (S56). The processor 2 ends the arrangement setting processing relating to the second pattern E2 (1, 3) when the variable K is 1 and the variable N is 3, and returns the processing to the main processing shown in FIG. 3. When the sewing start command has been detected (yes at S15), the processor 2 drives the sewing portion 30 and the movement portion 40 to sew the pattern Z4 on the sewing object C in accordance with the pattern data corrected at S14, and drives the thread cutting mechanism to cut the threads (S16). The processor 2 determines that the variable N is the last number corresponding to the variable K (yes at S17). The processor 2 determines whether the variable K is the last number (S19). When the variable K is 1, it is determined that the variable K is not the last number (no at S19). The processor 2 adds 1 to the variable K and sets the variable N to 0 (S20). The processor 2 performs the same notification as that at S11 (S21), and returns the processing to S7.

In the arrangement setting processing relating to a first pattern E1 (2) when the variable K is 2 and the variable N is 0, it is determined at S33 that the target pattern is not the first pattern E1 that is first in order (no at S33), and that the start point SP1 of the pattern Z1 (the first pattern E1) is set as the base point (S35). The user depresses the keys 72 so that the base point projected at S36 is aligned with the end point P12 of the sewn pattern Z4 (S61). When the depression of the keys 72 is detected (no at S37, yes at S38), the processor 2 corrects the pattern data and the graphic data of the target pattern Z1, in accordance with the type of the keys 72 indicating the movement direction of the embroidery frame 50 and the depression amount indicating the movement amount of the embroidery frame 50 (S39). The processor 2 returns the processing to S36. The user confirms that the position of the projected base point SP1 is aligned with the end point P12 of the sewn pattern Z4 on the sewing object C held by the embroidery frame 50, and thereafter depresses the key 75 (S62). The processing after that is the same as the arrangement setting processing relating to the first pattern E1 (1) when the variable K is 1 and the variable N is 0. The processing when the variable K is 2 or 3, and the processing when the variable K is 4 and the variable N is an integer from 0 to 2 are also performed in the same manner.

In the arrangement setting processing relating to a second pattern E2 (4, 3) when the variable K is 4 and the variable N is 3, the processor 2 performs the processing from S31 to S41 in the same manner as in the arrangement setting processing relating to the second pattern E2 (1, 3) when the variable K is 1 and the variable N is 3. It is determined that the variable K is the last number (yes at S42), and the processor 2 sets the end point P12 of the pattern Z4 and the graphic D3 as a mask M5 (S43).

Figure 20A:
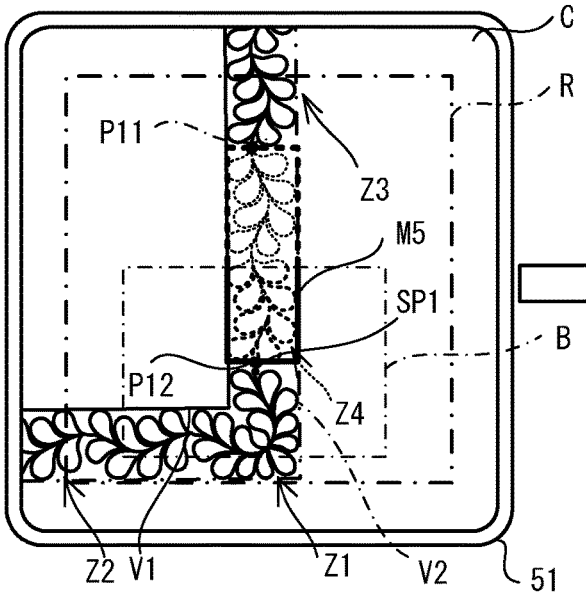
FIG. 20A is an explanatory diagram of a mask and the target pattern that are projected onto the sewing object held by the first frame.
Figure 20B:
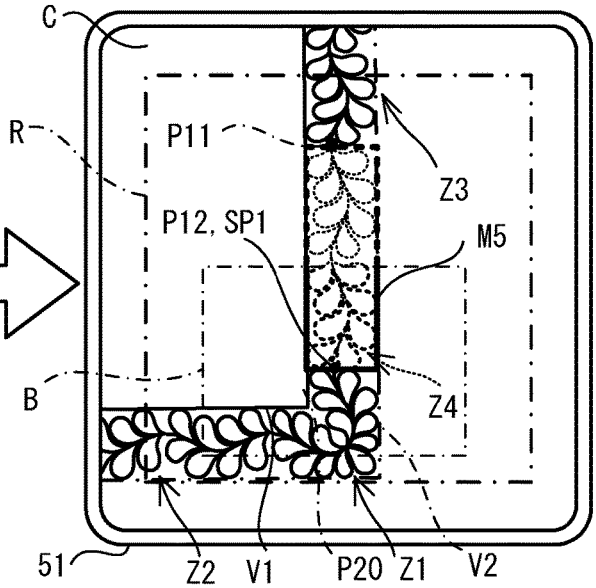
FIG. 20B is an explanatory diagram of a state in which the mask and the target pattern projected onto the sewing object are rotated around the base point to a position at which a point P12 matches a start point of the first pattern that is first in order, and are enlarged or contracted without changing the position of the base point.

The processor 2 controls the LCD 15 and displays a screen to instruct a change amount by which the arrangement of the target pattern Z4 is changed using the point P11 set at S35 as the base point (S46). For example, the processor 2 displays a screen 98 shown in FIG. 19. The screen 98 is the same as the screen 90 shown in FIG. 12. On the screen 98, of the keys 78 and 89, the key 78 set for the reference point is displayed such that it can be distinguished from the other keys 89. The processor 2 controls the movement portion 40 and the projector 58, and projects a part of the mask M5 set at S43 and a part of the target pattern Z4 onto the sewing object C inside the sewing area R, as shown in FIG. 20A, for example (S46). In FIG. 20A and FIG. 20B, the patterns Z1 to Z3 that have already been sewn on the sewing object C are shown by solid lines, the projected part of the pattern Z4 is shown by thick dotted lines, and the projected part of the mask M5 is shown by thick solid lines. The other part of the pattern Z4 that is on the outside of the projection area B is shown by thin dotted lines, and the other part of the mask M5 that is on the outside of the projection area B is shown by dotted lines.

As shown in FIG. 9, the user depresses the keys 76 so that the position of the point P12 of the mask M4 projected onto the sewing object C is aligned with the start point SP1 of the first pattern E1 that is first in order on the sewing object C held by the embroidery frame 50, and inputs a rotation amount by which the arrangement of the pattern Z4 is rotated using the point P11 as the base point (the center of rotation) (S63). As shown in FIG. 6 and FIG. 9, when the depression of the keys 76 is detected (no at S47, yes at S48), on the basis of the type of the keys 76 indicating the rotation direction and the rotation amount of the target pattern, the processor 2 corrects the graphic data representing the mask M5 so that the mask M5 is rotated around the point P11 (S51), and corrects the pattern data of the target pattern Z4 acquired at S31 (S52). The processor 2 returns the processing to S46. The processor 2 projects a part of the mask M5 on the basis of the graphic data corrected at S51, and projects a part of the pattern Z4 on the basis of the pattern data corrected at S52 (S46).

When, by simply rotating the pattern Z4 around the point P11, the position of the point P12 cannot be aligned with the start point SP1 of the first pattern E1 that is first in order on the sewing object C held by the embroidery frame 50, the user depresses the keys 77 so that the position of the point P12 projected onto the sewing object C is aligned with the point SP1 on the sewing object C held by the embroidery frame 50, and inputs a scale factor by which the pattern Z4 is enlarged or contracted in the length direction of the pattern Z4 using the point P11 as the base point (S63). When the depression of the keys 77 is detected (no at S47, no at S48, yes at S49), the processor 2 corrects the graphic data representing the mask M5 so that the mask M5 is enlarged or contracted using the point P11 as the base point, on the basis of the type and the depression amount of the keys 77 (S53), and corrects the pattern data of the target pattern Z4 acquired at S31 (S54). The processor 2 returns the processing to S46. As shown in FIG. 20B, the processor 2 projects a part of the mask M5 on the basis of the graphic data corrected at S51 and S53, and projects a part of the pattern Z4 on the basis of the pattern data corrected at S52 and S54 (S46).

The user confirms that the position of the point S12 on the projected mask M5 is aligned with the point SP1 on the sewing object C held by the embroidery frame 50, and thereafter depresses the key 75 (S64). When the processor 2 detects the depression of the key 75 (yes at S47), the processor 2 ends the projection. After that, the processor 2 controls the LCD 15 and displays the message that prompts the user to input the sewing start command (S56). The processor 2 ends the arrangement setting processing relating to the second pattern E2 (4, 3) when the variable K is 4 and the variable N is 3, and returns the processing to the main processing shown in FIG. 3. In the main processing shown in FIG. 3, when the processor 2 detects the sewing start command (yes at S15), the processor 2 drives the sewing portion 30 and the movement portion 40 to sew the pattern Z4 on the sewing object C in accordance with the pattern data corrected at S14, and drives the thread cutting mechanism to cut the threads (S16). The processor 2 determines that the variable N is the last number corresponding to the variable K (yes at S17), and the processor 2 determines that the variable K is the last number (yes at S19). The processor 2 ends the main processing.

Figure 21:
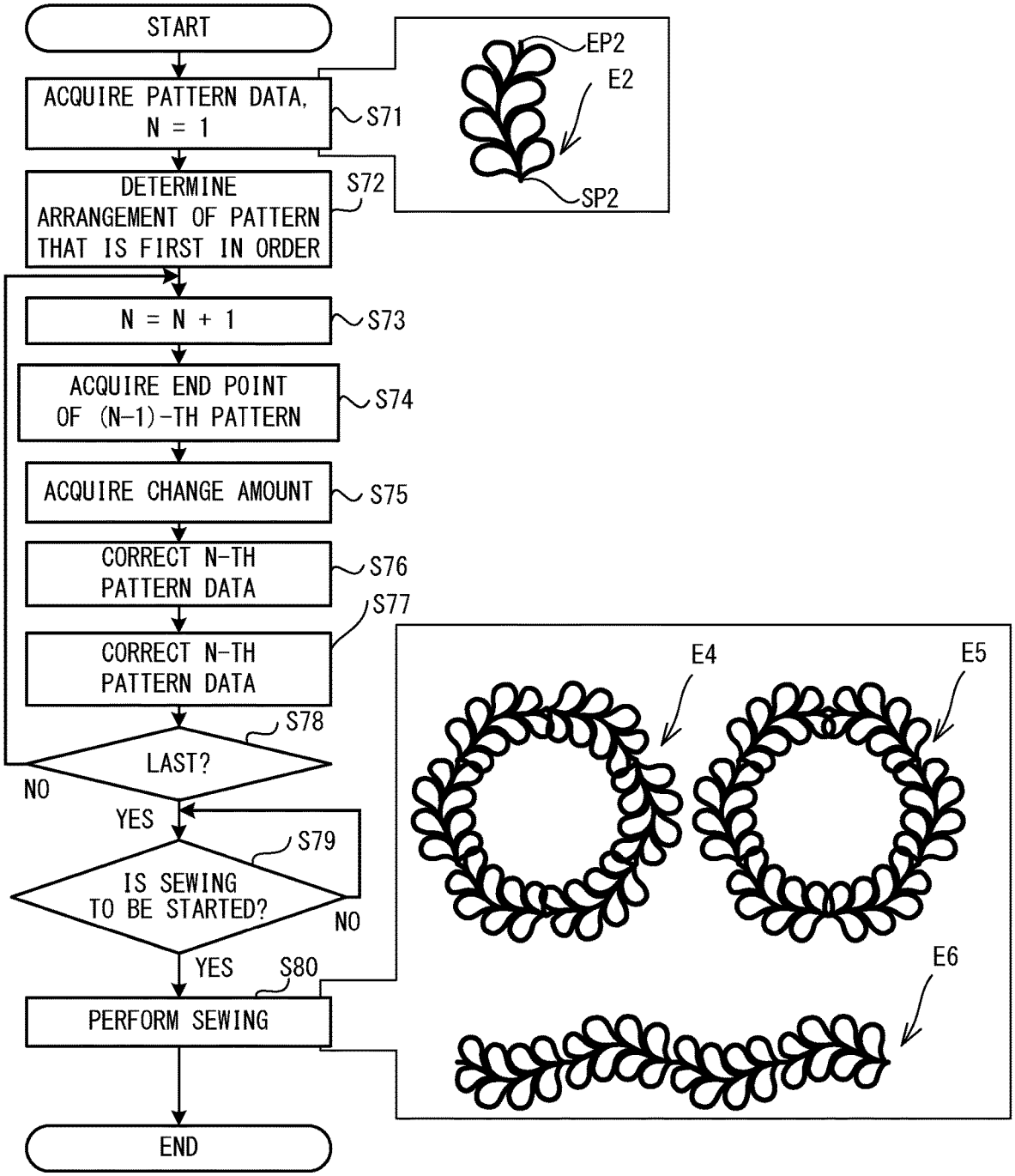
FIG. 21 is a flowchart of main processing of a second embodiment.

Main processing of the sewing machine 1 of a second embodiment will be explained with reference to FIG. 21. As a specific example, a case will be explained in which embroidery patterns E4 to E6 are sewn inside the sewing area R on the basis of one type of the second pattern E2. Although the main processing to sew each of the embroidery patterns E4 to E6 is performed at different timings, the following explanation is made in parallel in order to simplify the explanation. The main processing of the second embodiment is activated when the user inputs a command to start editing the embroidery pattern. When the processor 2 detects the command, the processor 2 reads out, to the RAM 83, a program to execute the main processing stored in the program storage area of the ROM 82. In accordance with instructions included in the program read out to the RAM 83, the processor 2 performs the following steps. In FIG. 21, the arrangement of the patterns is shown by defining the left-right direction and the up-down direction in FIG. 21, respectively, as the X direction and the Y direction of the embroidery coordinate system.

As shown in FIG. 21, the processor 2 acquires the pattern data of the second pattern E2, and sets the variable N indicating the number of the second patterns E2 to 1 (S71). After that, in accordance with a detection result of the panel operation, the processor 2 determines the arrangement of the pattern that is first in the sewing order (S72). The processor 2 corrects the pattern data corresponding to the second pattern E2 that is first in order, in accordance with the arrangement of the second pattern E2 that is first in order. The processor 2 adds 1 to the variable N (S73), and acquires the end point of the (N−1)-th pattern as the start point of the N-th pattern (S74).

In the case of the embroidery pattern E4, the processor 2 acquires the rotation amount as a change amount by which the arrangement of the N-th second pattern E2 is changed using the start point of the N-th second pattern E2 as the base point (S75). In the case of the embroidery pattern E5, the processor 2 acquires the rotation amount and presence/absence of inversion in the width direction of the second pattern E2, as the change amount by which the arrangement of the N-th second pattern E2 is changed using the start point of the N-th second pattern E2 as the base point (S75). When the second patter E2 is inverted in the width direction, the processor 2 interchanges the start point and the end point of the second pattern E2. In the case of the embroidery pattern E6, the processor 2 acquires the rotation amount and presence/absence of inversion in the length direction of the second pattern E2, as the change amount by which the arrangement of the N-th second pattern E2 is changed using the start point of the N-th second pattern E2 as the base point (S75).

The processor 2 moves the positions of the plurality of needle drop points represented by the pattern data acquired at S71, in accordance with a difference between the position of the sewing start point represented by the pattern data and the position of the end point of the (N−1)-th second pattern E2 acquired at S74, and corrects the pattern data of the N-th second pattern E2 (S76). Using the end point of the (N−1)-th second pattern E2 acquired at S74 as the base point, the processor 2 changes the positions of the plurality of needle drop points at which the sewing is performed on the basis of the pattern data corrected at S76, by the change amount acquired at S75, and further corrects the pattern data of the N-th second pattern E2 corrected at S76 (S77). The processor 2 determines whether an end command to end the arrangement setting of the embroidery pattern has been detected (S78). When the end command has not been detected (no at S78), the processor 2 returns the processing to S73. When the user ends the arrangement setting of the embroidery pattern, the user inputs the end command through the panel operation. When the end command has been detected (yes at S78), the processor 2 detects whether the sewing start command has been detected (S79). The processor 2 continues the determination processing at S79 until the sewing start command is detected (no at S79). When the sewing start command has been detected (yes at S79), the processor 2 reads out the pattern data of the N-th second pattern E2 in the sewing order, and drives the sewing portion 30 and the movement portion 40 to sew the embroidery pattern in accordance with the read out pattern data (S80). In the main processing of the second embodiment, the threads are not cut when each of the pattern data ends. The processor 2 ends the main processing.

The sewing machine 1 of the above-described first embodiment can align the patterns using the sewing start point acquired at S12 or S38 as the reference (S39, S52, S54). The sewing machine 1 of the second embodiment can perform the alignment of the N-th pattern, using the end point of the (N−1)-th pattern acquired at S74 as the sewing start point of the N-th pattern, and using the sewing start point as the reference (S74 to S77). Thus, the sewing machine 1 can perform the pattern alignment with a simpler operation than in related art.

The change amount of the first and second embodiments includes the rotation amount. The processor 2 of the first embodiment changes the positions of the needle drop points represented by the pattern data corrected at S39 to the positions obtained by rotating the pattern around the position of the sewing start point acquired at S38 by the change amount acquired at S48. The processor 2 of the second embodiment changes the positions of the needle drop points represented by the pattern data corrected at S76 to the positions obtained by rotating the pattern around the position acquired at S74 by the change amount acquired at S75. Thus, the sewing machine 1 of the first and second embodiments can perform the pattern alignment by rotating the pattern using the acquired sewing start point as the reference.

The change amount of the first embodiment includes the scale factor. The processor 2 changes the positions of the needle drop points represented by the pattern data corrected at S39 to the positions obtained by enlarging or contracting the pattern by the change amount acquired at S49, using the position of the sewing start point acquired at S38 as the reference. Thus, the sewing machine 1 of the first embodiment can perform the pattern alignment by enlarging or contracting the pattern using the sewing start point acquired at S38 as the reference.

When a plurality of patterns are connected to form one embroidery pattern as a whole, after one pattern is completed in accordance with the pattern data and before sewing the pattern that is next in the sewing order after the one pattern, the processor 2 of the first embodiment acquires the position of the sewing start point of the next pattern (S12, S39). Thus, the sewing machine 1 allows the position in accordance with the actual sewing result of the one pattern to be acquired as the sewing start point at S12 or S39. When a plurality of patterns are connected to form one embroidery pattern as a whole, the sewing machine 1 of the first embodiment can set the arrangement of the next pattern while taking account of the actual sewing result of the one pattern.

The processor 2 of the first embodiment acquires the size of the rectangular frame-shaped embroidery pattern (S3). The processor 2 acquires the first pattern E1 that is arranged in each of the four corner portions 61 of the rectangular frame-shaped embroidery pattern, and the second patterns E2 that are arranged in each of the four side portions 62 that connect the four corner portions 61 to form the rectangular frame shape (S1). On the basis of the size of the embroidery pattern acquired at S3, the processor 2 determines the number of the second patterns E2 that are arranged in each of the four side portions 62 (S4). The processor 2 generates the embroidery data including the pattern data corresponding to the first pattern E1 and each of the second patterns E2 (S5). The embroidery data is data to sew the embroidery pattern in which the first pattern E1 acquired at S1 is arranged in each of the four corner portions 61 and the number determined at S4 of the second patterns E2 acquired at S1 are arranged in each of the four side portions 62. In accordance with the sewing order, the processor 2 acquires the plurality of pattern data included in the embroidery data generated at S5 (S31). Thus, when sewing the frame-shaped embroidery pattern formed by combining the first patterns E1 and the second patterns E2, the sewing machine 1 of the first embodiment can perform the pattern alignment with a relatively simple operation during the sewing, by using the positions of the actually sewn stitches to perform the pattern alignment.

The processor 2 of the first embodiment acquires the size of the sewing area R that is set inside the embroidery frame 50 (S2). The processor 2 generates the embroidery data including the pattern data to sew the first pattern E1 and the pattern data to continuously sew the maximum number of the second patterns E2 that can be contained within the sewing area R acquired at S2, in a range equal to or smaller than the number of the second patterns E2 determined at S4 (S5). Thus, the sewing machine 1 of the first embodiment can shorten a time period required to sew the embroidery pattern, in comparison to when the pattern data is generated for each of the second patterns E2.

The processor 2 of the first embodiment performs the notification of the position of the sewing start point represented by the pattern data acquired at S31 (S36). After notifying the user of the position of the sewing start point at S36, the processor 2 acquires the position of the sewing start point (S38). For example, the user can set the position of the sewing start point while referring to the notification result (S61, S62). Thus, the sewing machine 1 of the first embodiment allows the position of the sewing start point to be acquired using the notified position of the sewing start point as the reference.

The processor 2 of the first embodiment performs the notification of the position of at least one selected from the group of the two corners that are in contact with the side separated from the sewing start point, among the four corners of the rectangular mask area indicating the position and the size of the pattern represented by the pattern data corrected at S39 (S45, S46). The processor 2 acquires the change amount after notifying the user of the position of at least one selected from the group of the two corners at S46 (S48, S49). For example, the user can set the change amount while referring to the notification result (S63). Thus, the sewing machine 1 of the first embodiment allows the change amount to be acquired using the notified position of the corner portion as the reference.

When the pattern data to sew the second pattern E2 that is arranged in the side portion 62 and that is last in the sewing order is acquired, the processor 2 of the first embodiment performs the notification of the position of at least one selected from the group of the point 65 at the inner corner and the point 66 at the outer corner of the corner portion 61, which is one of the four corner portions 61 and in which the first pattern E1 adjacent to the second pattern E2 is arranged (S44, S46). The processor 2 acquires the change amount after notifying the user of the position of at least one selected from the group of the inner corner and the outer corner at S46 (S48, S49). Thus, the sewing machine 1 of the first embodiment allows the change amount to be acquired using the notified position of at least one selected from the group of the inner corner and the outer corner as the reference.

The sewing machine 1 is provided with the projector 58. Before sewing the pattern at S9 and S16, the processor 2 of the first embodiment projects the pattern represented by the pattern data corrected at S39, S52 and S54 onto the position represented by the corrected pattern data (S36, S46). Thus, the sewing machine 1 of the first embodiment can use the projector 58 to project the arrangement of the pattern represented by the corrected pattern data. The user can confirm the result of the pattern alignment before the sewing. The sewing machine 1 can reduce a possibility that the pattern is sewn at a position that is not intended by the user.

The sewing machine and the pattern alignment method of the present disclosure are not limited to the above described embodiment, and various changes may be made without departing from the spirit and scope of the present disclosure. For example, the following modifications may be added as appropriate.

(A) The configuration of the sewing machine 1 on which the embroidery frame 50 can be mounted may be changed as appropriate. The sewing machine 1 may be an industrial sewing machine or a multi-needle sewing machine. It is sufficient that the movement portion 40 be able to relatively move the holder 43 with respect to the needle bar 6 in a first direction and a direction that intersects the first direction. The movement portion 40 may be formed integrally with the sewing machine 1. The shape and the size of the embroidery frame 50 may be changed as appropriate, and the embroidery frame 50 may have a circular shape, an oval shape or the like. The projector 58 may be omitted from the sewing machine 1 of the second embodiment. The sewing machine 1 of the first embodiment may be provided with a light irradiation device, such as a laser pointer, in place of the projector 58. The installation position, the projection area B and the like of the projector 58 may be changed as appropriate.

(B) The program including the instructions to cause the main processing shown in FIG. 3 and FIG. 21, to be executed may be stored in a storage device of the sewing machine 1 until the processor 2 executes the program. Therefore, an acquisition method of the program, an acquisition route, and the device that stores the program may each be changed as appropriate. The program to be executed by the processor 2 may be received from another device via a cable or wireless communication, and may be stored in a storage device, such as a flash memory. Examples of the other device include a PC and a server connected via a network.

(C) The respective steps of the main processing performed by the sewing machine 1 are not limited to the example in which they are performed by the processor 2, and a part or all of the steps may be performed by another electronic device (an ASIC, for example). The respective steps of the main processing may be performed through distributed processing by a plurality of electronic devices (a plurality of CPUs, for example). The respective steps of the main processing can be changed in order, omitted or added, as necessary. An aspect in which an operating system (OS) or the like operating on the sewing machine 1 performs a part or all of the main processing on the basis of a command from the processor 2 is also included in the scope of the present disclosure. For example, the following modifications from (C-1) to (C-4) may be added to the main processing, as appropriate.

(C-1) The type, the number, the shape and the size of the patterns acquired at S71 may be changed as appropriate. Each of the graphics used as the reference for the size of the first pattern and the second pattern may be a smallest rectangle, a rectangle, a circle, an ellipse or the like that encompasses the pattern, or may be a graphic that does not encompasses the pattern. The graphic used as the size reference need not necessarily be set for the first pattern and the second pattern. In this case, the user may set the graphic used as the size reference, as appropriate. The first pattern and the second pattern acquired at S4 may be stored in the flash memory 84 or the like, may be graphics created by the user through the panel operation or the like, or may be acquired from an external device connected to the sewing machine 1. The patterns acquired at S1 need not necessarily be arranged in the rectangular frame-shaped area 60. The embroidery pattern formed by combining the plurality of patterns may be an annular pattern, such as the embroidery patterns E3 to E5, or may be a pattern that is not annular, such as the embroidery pattern E6.

(C-2) The method for generating the embroidery data may be changed as appropriate. For example, without setting the length in the width direction, the processor 2 may arrange the first patterns E1 and the second patterns E2 in a frame shape in accordance with the size of the embroidery pattern, without enlarging or contracting the first patterns E1 and the second patterns E2 or enlarging or contracting them to a predetermined size. For example, in Expression (4) and Expression (5), the processor 2 rounds off the argument using the Round function. However, the argument may be rounded down or rounded up to an integer. When the second patterns E2 are arranged in each of the side portions 62 on the basis of the calculated number of the second patterns E2, when the second patterns E2 cannot be enlarged or contracted by the same scale factor in the X direction and the Y direction, the processor 2 may generate the embroidery pattern in which the start point and the end point of the adjacent patterns are connected using a connection line (a straight line, for example). When the embroidery pattern is divided a plurality of times and sewn, it is sufficient that the pattern data used each time be generated before the sewing based on the pattern data is performed, and the pattern data used each time need not necessarily be generated before the sewing based on the pattern data that is first in the sewing order is performed. The embroidery data to sew the embroidery pattern may include the pattern data for each of the second patterns E2, or may include the pattern data to sew the first pattern E1 and the second pattern E2 that are contained within the same sewing area R, without cutting the threads during the sewing.

(C-3) The method for acquiring the position of the sewing start point (the base point) of the pattern may be changed as appropriate. For example, when a plurality of patterns are connected to form one embroidery pattern as a whole, the processor 2 may acquire the position of the sewing start point of each of the patterns before starting the sewing of the embroidery pattern, as in the second embodiment. The sewing machine 1 may project a graphic indicating the position of at least one of two corners (vertices of the mask, for example) that are in contact with the side separated from the sewing start point, among the four corners of the rectangular mask indicating the position and the size of the pattern represented by the pattern data corrected at S39 or S40, and need not necessarily project one selected from the group of the mask and the pattern (S46). At S46, the sewing machine 1 may project the pattern corrected at S39 or S40, or the mask (S46). The sewing machine 1 may acquire the position of the base point without notifying the user of the position of the base point using the projector 58. For example, when the sewing machine 1 is provided with an imaging portion, the sewing machine 1 may acquire the position of the corner of the line V1 on the sewing object C or the position of the end point of an immediately preceding pattern in the sewing order, from a captured image obtained by capturing an image of the sewing object C held by the embroidery frame 50, and may set the position of the base point. In this case, for example, the user may specify the position of the base point on the sewing object C using a light pen or the like at the time of image capture. When the sewing machine 1 is provided with an ultrasonic pen and an ultrasonic receiver, the sewing machine 1 may use the ultrasonic receiver to receive a result obtained by the user using the ultrasonic pen and specifying the position of the base point on the sewing object C, and may acquire the position of the base point. The sewing machine 1 may notify the user of the position of the base point by moving the position of the base point corresponding to the pattern data acquired at S31 to the position below the needle bar 6. In this case, the user may input the position of the base point by moving the position of the corner of the line V1 on the sewing object C or the position of the end point of the immediately preceding pattern in the sewing order to the position below the needle bar 6, and the sewing machine 1 may acquire the position of the base point on the basis of the result input by the user. The operation performed by the user may be changed in accordance with the reference graphic of the sewing object C. For example, when the reference graphic of the sewing object C is the line V2, the user may perform the operation at S63 such that a point arranged on the outer peripheral contour 63 of the area 60 may be arranged on the line V2. For example, when the position of the sewing start point is set to the end point of the immediately preceding pattern in the sewing order, the operations by the user at S61 and S62 may be omitted as appropriate. At S61, the user may input the movement amount to specify the position of the sewing start point of the next pattern, so that the pattern is overlapped with the immediately preceding pattern in the sewing order by a few stitches. The reference graphic on the sewing object C may be changed as appropriate, and the user may change the method for inputting the movement amount at S61 and S63 in accordance with the reference graphic. In the sewing machine 1, the setting method of at least one selected from the group of the base point, the reference point and the mask may be the same, irrespective of the variable K and the variable N. As in the second embodiment, the sewing machine 1 need not necessarily perform the processing relating to the mask that represents the size and the position of the pattern. When the pattern data is acquired to sew the second pattern that is arranged in the side portion 62 of the area 60 and that is last in the sewing order, the sewing machine 1 may notify the user of the point 66 at the outer corner of the corner portion 61 which is one of the four corner portions 61 of the area 60 and in which the first pattern adjacent to the second pattern is arranged.

(C-4) The sewing machine 1 may use, as the change amount, one of the rotation amount or the scale factor of the size of the pattern. The method for acquiring the change amount may be changed as appropriate. As in the sewing machine 1 of the second embodiment, the processor 2 may acquire, as the change amount, the numeric value input by the user through the panel operation or the like. The sewing machine 1 may acquire the change amount without notifying the user of the mask of the pattern and the position of the pattern using the projector 58. For example, when the sewing machine 1 is provided with the imaging portion, the processor 2 may acquire the line V1 on the sewing object C from a captured image obtained by capturing an image of the sewing object C held by the embroidery frame 50, and may set the change amount of the pattern when the sewing start point of the pattern is used as the reference. In this case, the user may specify the position of the line V1 on the sewing object C using the light pen or the like at the time of image capture. When the sewing machine 1 is provided with the ultrasonic pen and the ultrasonic receiver, the processor 2 may use the ultrasonic receiver to receive a result obtained by the user using the ultrasonic pen and specifying the line V1 on the sewing object C, and may acquire the change amount of the pattern when the sewing start point of the pattern is used as the reference. The sewing machine 1 may notify the user of the position of the reference point, by moving the position of the reference point corresponding to the pattern data acquired at S31 to the position below the needle bar 6. In this case, the user may input the position of the reference point by moving the line V1 on the sewing object C to the position below the needle bar 6, and the sewing machine 1 may acquire the change amount of the pattern on the basis of the result input by the user.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion having a needle bar, the sewing portion being configured to form stitches on a sewing object by moving the needle bar up and down;

a movement portion having a holder on which an embroidery frame that holds the sewing object is detachably mounted, the movement portion being configured to move the holder with respect to the needle bar;

a processor configured to control the sewing portion and the movement portion; and a memory configured to store computer-readable instructions that, when executed by the processor, instruct the processor to perform processes comprising:

acquiring pattern data indicating positions of a plurality of needle drop points to sew a pattern, using a coordinate system of the movement portion;

acquiring a position of a sewing start point of the pattern indicated by the coordinate system of the movement portion;

performing first correction that corrects the pattern data by moving the positions of the plurality of needle drop points represented by the acquired pattern data in accordance with a difference between a position of the sewing start point represented by the pattern data and the acquired position of the sewing start point;

acquiring a change amount by which the positions of the plurality of needle drop points represented by the pattern data corrected by the first correction are changed, using the acquired position of the sewing start point as a base point;

performing second correction that uses the acquired position of the sewing start point as the base point, and corrects the pattern data corrected by the first correction, by changing, by the acquired change amount, the positions of the plurality of needle drop points represented by the pattern data corrected by the first correction; and controlling the sewing portion and the movement portion and sewing the pattern on the sewing object held by the embroidery frame, in accordance with the pattern data corrected by the second correction.

2. The sewing machine according to claim 1, wherein the change amount is a rotation amount, and the second correction changes the positions of the plurality of needle drop points represented by the pattern data corrected by the first correction to positions obtained by rotating, by the acquired change amount, the positions of the plurality of needle drop points around the acquired position of the sewing start point, and thus corrects the pattern data corrected by the first correction.

3. The sewing machine according to claim 1, wherein the change amount is a scale factor, and the second correction changes the positions of the plurality of needle drop points represented by the pattern data corrected by the first correction to positions obtained by enlarging or contracting the pattern by the acquired change amount, using the acquired position of the sewing start point as the base point, and thus corrects the pattern data corrected by the first correction.

4. The sewing machine according to claim 1, wherein the acquiring the position of the sewing start point includes, when a plurality of the patterns are connected and one embroidery pattern is formed as a whole, after one of the patterns is completed in accordance with the pattern data and before sewing the pattern that is next in a sewing order after the one pattern, acquiring the position of the sewing start point of the next pattern.

5. The sewing machine according to claim 4, wherein the computer-readable instructions further instruct the processor to perform processes comprising:

acquiring a size of the embroidery pattern having a rectangular frame shape, acquiring a first pattern that is arranged in each of four corner portions of the rectangular frame-shaped embroidery pattern, and a second pattern that is arranged in each of four side portions that connect the four corner portions to form the rectangular frame shape, determining a number of the second patterns arranged in each of the four side portions, on the basis of the acquired size of the embroidery pattern, and generating embroidery data including the pattern data corresponding to each of the first pattern and the second pattern, the embroidery data being data to sew the embroidery pattern in which the acquired first pattern is arranged in each of the four corner portions and the determined number of the acquired second patterns are arranged in each of the four side portions, and the acquiring the pattern data includes acquiring a plurality of the pattern data included in the generated embroidery data in accordance with the sewing order.

6. The sewing machine according to claim 5, wherein the computer-readable instructions further instruct the processor to perform processes comprising:

acquiring a size of a sewing area that is set inside the embroidery frame, and the generating the embroidery data includes generating the embroidery data including the pattern data to sew the first pattern, and the pattern data to continuously sew a maximum number of the second patterns contained within the acquired area, in a range equal to or less than the determined number of the second patterns.

7. The sewing machine according to claim 5, wherein the computer-readable instructions further instruct the processor to perform processes comprising:

performing, when the pattern data to sew the second pattern which is arranged in the side portion and which is last in the sewing order is acquired, notification of a position of at least one selected from the group of an inner corner and an outer corner of the corner portion which is one of the four corner portions and in which the first pattern adjacent to the second pattern is arranged, and the acquiring the change amount includes acquiring the change amount in accordance with a movement amount of the notified position of the at least one selected from the group of the inner corner and the outer corner, after the position of the at least one selected from the group of the inner corner and the outer corner is notified.

8. The sewing machine according to claim 1, wherein the computer-readable instructions further instruct the processor to perform processes comprising:

performing notification of the position of the sewing start point represented by the acquired embroidery data, and the acquiring the position includes acquiring the position of the sewing start point after the position of the sewing start point is notified.

9. The sewing machine according to claim 1, wherein the computer-readable instructions further instruct the processor to perform processes comprising:

performing notification of a position of at least one of two corners that are in contact with a side separated from the sewing start point, among four corners of a mask that is a rectangular graphic indicating a position and a size of the pattern represented by the pattern data corrected by the first correction, and the acquiring the change amount includes acquiring the change amount after the position of the at least one of the two corners is notified.

10. The sewing machine according to claim 1, further comprising:

a projector, wherein the computer-readable instructions further instruct the processor to perform processes comprising projecting the pattern represented by the pattern data corrected by at least one selected from the group of the first correction and the second correction, onto a position represented by the pattern data, before sewing the pattern.

11. A pattern alignment method comprising:

a pattern data acquiring step of acquiring pattern data to sew a pattern using a sewing machine, the sewing machine including a sewing portion, a movement portion and a processor, the sewing portion having a needle bar and being configured to form stitches on a sewing object by moving the needle bar up and down, the movement portion having a holder and moving the holder with respect to the needle bar, the holder being configured to detachably mount thereon an embroidery frame that holds the sewing object, the processor being configured to control the sewing portion and the movement portion, and the pattern data indicating positions of a plurality of needle drop points to sew the pattern using the sewing machine, using a coordinate system of the movement portion;

a position acquiring step of acquiring a position of a sewing start point of the pattern indicated by the coordinate system of the movement portion;

a first correcting step of correcting the pattern data by moving the positions of the plurality of needle drop points represented by the pattern data acquired by the pattern data acquiring step, in accordance with a difference between a position of the sewing start point represented by the pattern data and the position of the sewing start point acquired by the position acquiring step;

a corner portion notifying step of performing notification of a position of at least one of two corner portions that are in contact with a side separated from the sewing start point, among four corner portions of a mask that is a rectangular graphic indicating a position and a size of the pattern represented by the pattern data corrected by the first correcting step;

a change amount acquiring step of acquiring a change amount when the position of the at least one of the two corners notified by the corner portion notifying step is changed in accordance with a position of a reference graphic on the sewing object held by the embroidery frame;

a second correcting step of correcting the pattern data corrected by the first correcting step, by changing the positions of the plurality of needle drop points represented by the pattern data corrected by the first correcting step, in accordance with the change amount acquired by the change amount acquiring step, using the position of the sewing start point acquired by the position acquiring step as a base point; and a sewing control step of controlling the sewing portion and the movement portion and sewing the pattern on the sewing object held by the embroidery frame, in accordance with the pattern data corrected by the second correcting step.

* * * * *